US009114518B2

(12) United States Patent
Aoki et al.

(10) Patent No.: US 9,114,518 B2
(45) Date of Patent: Aug. 25, 2015

(54) STAPLER

(75) Inventors: Akira Aoki, Tokyo (JP); Takuya Kubota, Tokyo (JP)

(73) Assignee: MAX CO., LTD., Tokyo (JP)

( * ) Notice: Subject to any disclaimer, the term of this patent is extended or adjusted under 35 U.S.C. 154(b) by 497 days.

(21) Appl. No.: 13/517,899

(22) Filed: Jun. 14, 2012

(65) Prior Publication Data

US 2013/0001269 A1 Jan. 3, 2013

(30) Foreign Application Priority Data

Jul. 1, 2011 (JP) ..... 2011-147681
Jul. 1, 2011 (JP) ..... 2011-147682
Jul. 1, 2011 (JP) ..... 2011-147683
Jul. 1, 2011 (JP) ..... 2011-147686

(51) Int. Cl.
*B25C 5/02* (2006.01)
*B25C 5/16* (2006.01)

(52) U.S. Cl.
CPC ..... *B25C 5/1617* (2013.01); *B25C 5/0207* (2013.01); *B25C 5/1637* (2013.01)

(58) Field of Classification Search
CPC ..... B25C 5/162; B25C 5/0242
USPC ..... 227/120, 155, 154, 127, 128, 135, 156, 227/129
See application file for complete search history.

(56) References Cited

U.S. PATENT DOCUMENTS 5,758,813 A * 6/1998 Kikuchi et al. ..... 227/155
7,124,925 B2 10/2006 Ishizaki
7,228,999 B2 6/2007 Oide et al.
7,621,433 B2 11/2009 Ivarsson
7,644,851 B2 1/2010 Sugihara et al.
8,002,161 B2 8/2011 Maemori
2005/0077338 A1 4/2005 Ishizaki
2006/0043146 A1 3/2006 Oide et al.
2007/0023474 A1* 2/2007 Smith et al. ..... 227/155
2007/0210135 A1 9/2007 Ivarsson
2007/0210136 A1 9/2007 Sugihara et al.
2009/0072003 A1 3/2009 Matsukawa
2009/0152318 A1* 6/2009 Matsukawa ..... 227/129
2010/0059569 A1 3/2010 Maemori
2010/0096430 A1* 4/2010 Sugihara et al. ..... 227/155

FOREIGN PATENT DOCUMENTS

| | | |
|---|---|---|
| CN | Y-2594010 | 12/2003 |
| CN | Y-2681904 | 3/2005 |
| CN | A-1697722 | 11/2005 |
| CN | A-1852791 | 10/2006 |
| EP | A1-0761392 | 3/1997 |
| JP | UM-S62-35779 | 3/1987 |
| JP | 6-16664 | 5/1994 |
| JP | A-2003-205506 | 7/2003 |
| JP | A-2005-22079 | 1/2005 |
| JP | A-2005-297146 | 10/2005 |
| JP | A-2007-520362 | 7/2007 |
| JP | A-2008-80450 | 10/2008 |
| JP | 2009-72846 | 4/2009 |
| WO | WO 2005/075151 | 8/2005 |

* cited by examiner

*Primary Examiner* — Nathaniel Chukwurah
(74) *Attorney, Agent, or Firm* — Drinker Biddle & Reath LLP

(57) ABSTRACT

A clincher unit is provided with a pair of clinchers for bending two legs of a staple; and a clincher driving mechanism for rotating and moving the clinchers in separating/contacting directions. The clincher driving mechanism moves the pair of clinchers in an approaching direction each other, as a movement of starting to bend the legs of the staple having penetrated the sheets.

13 Claims, 32 Drawing Sheets

STAPLER

BACKGROUND OF THE INVENTION

1. Field of the Invention

The present invention relates to a stapler having moveable clinchers.

2. Related Art

In a large-sized stapler for binding many sheets or a stapler in which legs of a staple are linearly bent on a backside of a sheet along the backside of the sheet, a clincher mechanism that bends the legs of the staple after the staple penetrates the sheets may be adopted.

The clincher mechanism has a pair of clinchers that can rotate to correspond to two legs of the staple having penetrated the sheets and a clincher support part that rotates the clinchers in a pushing up direction by an ascent and descent operation of the clinchers. The clincher mechanism also has a slider that performs lock and lock-release at a standby position of the clinchers and a link that transmits movement of a handle to the slider (for example, refer to Patent Documents 1 and 2).

Patent Document 1: JP-Y-06-016664

Patent Document 2: JP-A-2009-072846

In the conventional clinchers, when the staple penetrates the sheets by pressing a handle, movement of the link is transmitted to the slider and the lock of a clincher holder to which the clinchers are rotatably attached is released.

When the lock of the clincher holder is released, the clincher holder is pressed and descends by the force of pressing the sheets. As the clincher holder descends, the pair of clinchers is pushed up and rotated upward by the clincher support part, thereby bending the legs of the staple. Then, when the force of pressing the handle is released, the clincher holder is returned to the standby position together with the clinchers.

In the configuration of bending the legs of the staple by the rotating operation of the pair of left and right clinchers, when there are many sheets to be bound and a protruding amount of the legs from the backside of the sheet is small, the legs collide with clincher surfaces at upper sides of rotating fulcrum points of the clinchers.

At this state, when the clinchers rotate, as movement of starting to bend the legs, a force of lifting up the legs outward is applied. Thereby, it is not possible to bend the legs of the staple inward.

In order to solve the above problem, it is necessary to adopt a staple having longer legs so as to enable the legs to protrude from the backside of the sheet by a predetermined amount or larger even when there are many sheets to be bound. However, when the staple having longer legs is used, it is necessary to widen a width of a staple crown as the increased length of the legs so that the bound legs do not protrude beyond the width of the staple crown in a case where the smaller number of sheets is bound by the staple having longer legs.

Since it is also necessary to widen the width of the staple crown, a width of a magazine is increased and the whole apparatus is enlarged.

Also, since it is necessary to change a type of the staple depending on the number of sheets to be bound, the usability for a user is poor.

Further, in the stapler moving the clinchers, the clincher holder having the clinchers attached thereto is applied with the force of pushing up the same by a return spring. The slider that locks the ascent and descent of the clincher holder is typically provided at the rear of the clinchers.

In the large staplers, the handle is also configured to extend to the front of the clinchers so as to apply a large force, in many cases. Also, the return spring that pushes up the clincher holder is attached to the front of the clinchers with avoiding the slider.

Therefore, the clincher holder is applied with the force of pushing up the front side thereof by the return spring. Also, due to the load that is applied when the staple penetrates the sheets, the clincher holder is applied with the force of pushing up the rear side thereof by the slider. Hence, the clincher holder is inclined forward about the slider serving as a fulcrum.

Thereby, according to the conventional stapler, the rearward inclined state of the clincher holder at the standby state is changed to the forward inclined state by the load that is applied when the staple penetrates the sheets. However, when the inclination of the clincher holder is changed before and after the penetrating load is applied, a position of the sheets is deviated. As a position of the sheets is deviated, the legs are deviated in the front-rear direction in the sheets during the penetration, so that the legs may not penetrate the sheets and thus the sheets may not be bound. Also, in the stapler disclosed in Patent Document 2, a clincher frame and a clincher cover are enlarged, so that the cost is increased.

Further, in the stapler where the staple having long legs can be used, if the legs are linearly bent, the legs may overlap each other when the number of sheets to be bound is small. Hence, in order to avoid the overlapping of the legs, a configuration is adopted in which a pair of clinchers is slightly offset in a front-rear direction. As disclosed in Patent Document 2, recesses are formed on upper surfaces of the clinchers, thereby guiding the legs upon the bending.

However, in the configuration where the clinchers are formed with the recesses to guide the legs, it is necessary to secure a thickness of a convex part between the recess and the recess, so that it is not possible to narrow the interval between the legs. When an interval between the legs is wide, a user may feel the finishing poor. Also, when the clinchers are formed with the recesses by the cutting processing and the like, the cost of parts is increased.

Further, in the configuration where the legs of the staple are bent by the rotation operation of the pair of clinchers, the clinchers are not applied with the urging force in the rotating direction. Hence, at the state where the clincher unit is at the standby position, the clinchers are rotated downward and are pushed up by the clincher support part.

Even when the clinchers are rotated downward at the standby position, it does not influence on the operation of bending the legs of the staple. However, at this state, a space is formed at the inside of the clincher holder, so that the foreign matters are introduced therein. Also, the outward appearance may be deteriorated.

SUMMARY OF THE INVENTION

Embodiments of the invention relates to a stapler enabling legs of a staple to be securely bent inward.

DETAILED DESCRIPTION OF THE EMBODIMENTS

Figure 1:
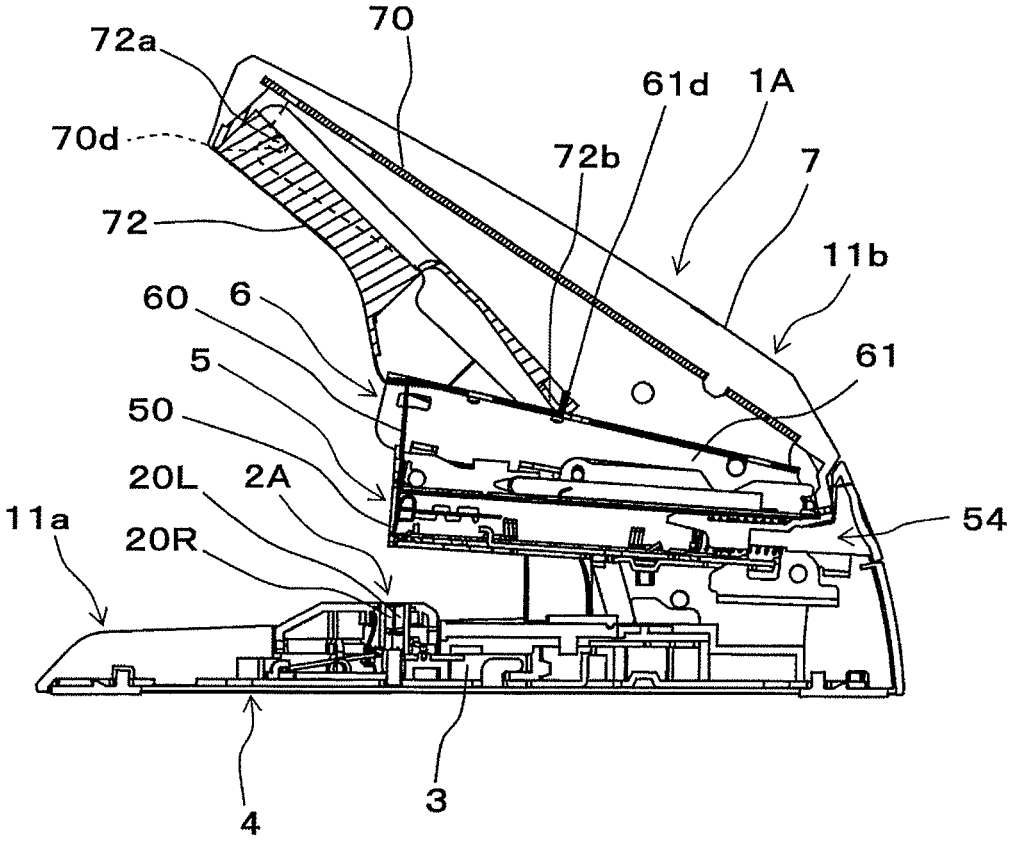
FIG. 1 is a side sectional view showing a detailed internal configuration of a stapler according to an exemplary embodiment.
Figure 2:
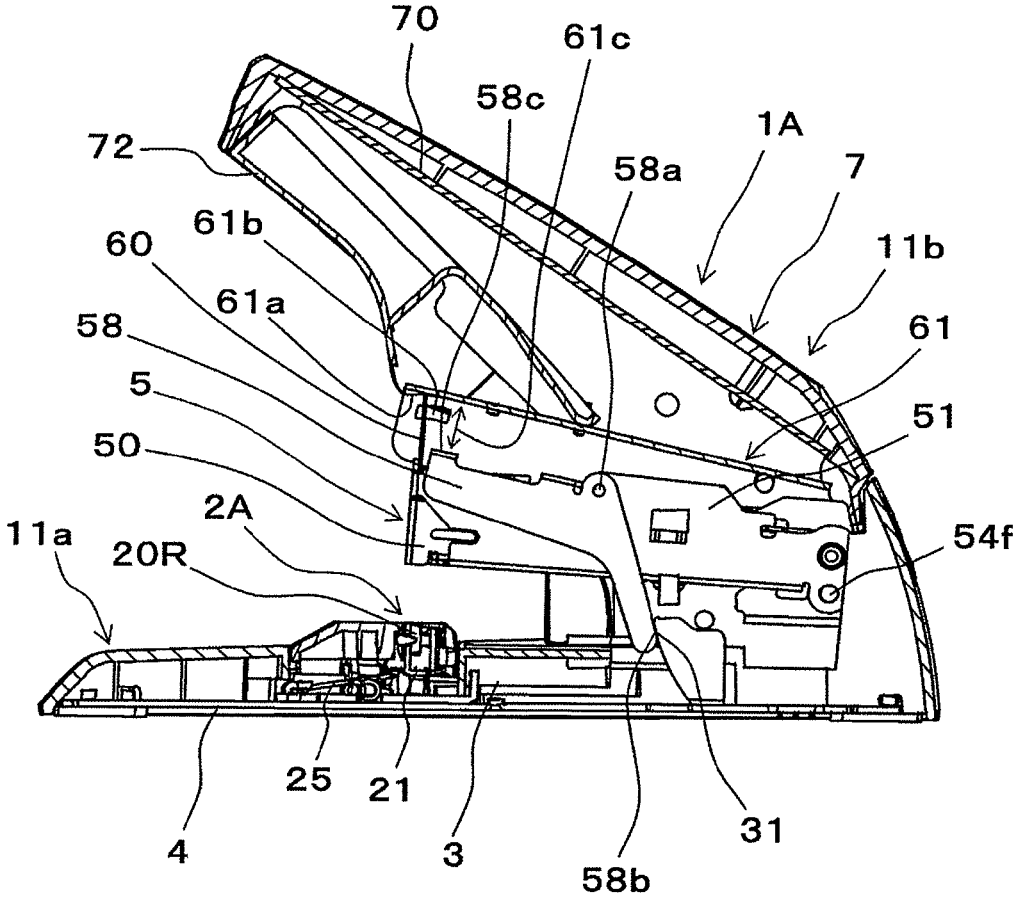
FIG. 2 is a side sectional view showing an internal configuration of the stapler according to an exemplary embodiment.
Figure 3:
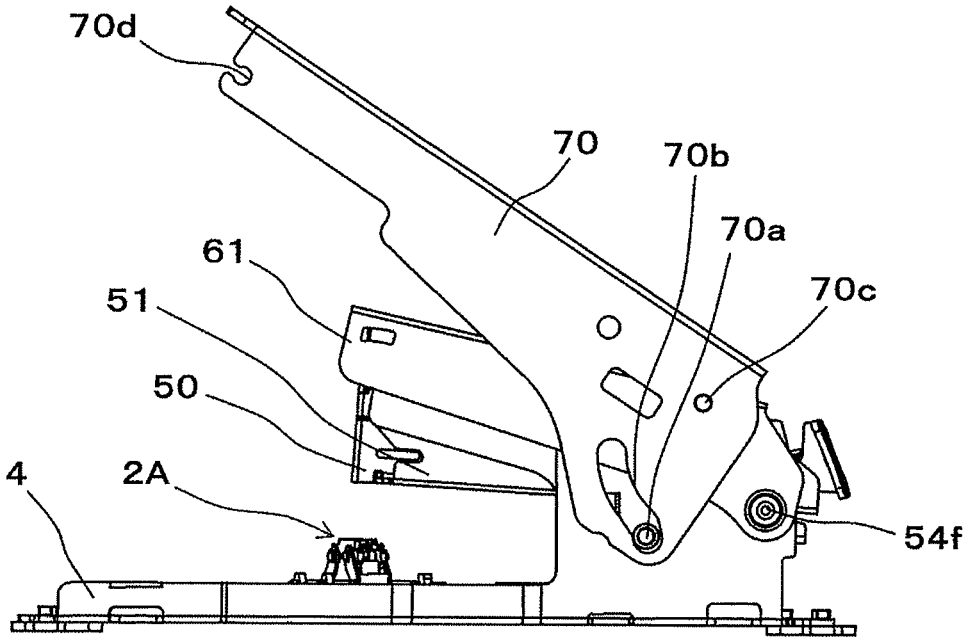
FIG. 3 is a side view of the stapler of the exemplary embodiment with a cover being removed.
Figure 4:
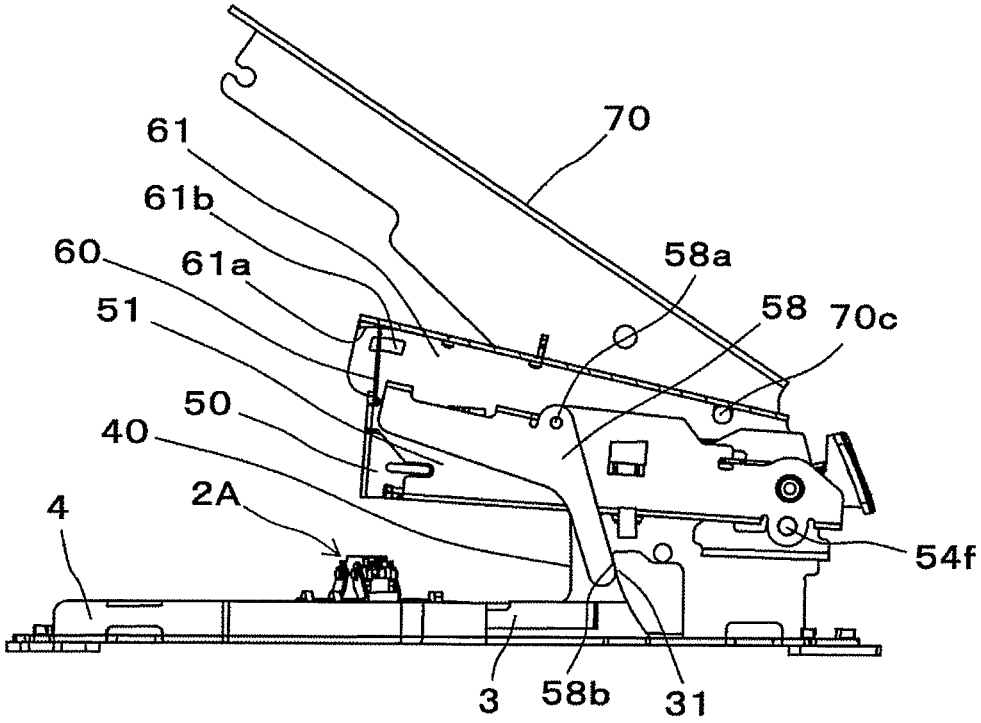
FIG. 4 is a side sectional view showing an internal configuration of the stapler of the exemplary embodiment with the cover being removed.

Hereinafter, exemplary embodiments of the invention will be described with reference to the drawings. FIG. 1 is a side sectional view showing a detailed internal configuration of a stapler according to an exemplary embodiment, FIG. 2 is a side sectional view showing an internal configuration of the stapler according to an exemplary embodiment, FIG. 3 is a side view of the stapler of the exemplary embodiment with a cover being removed and FIG. 4 is a side sectional view showing an internal configuration of the stapler of the exemplary embodiment with the cover being removed.

Figure 5:
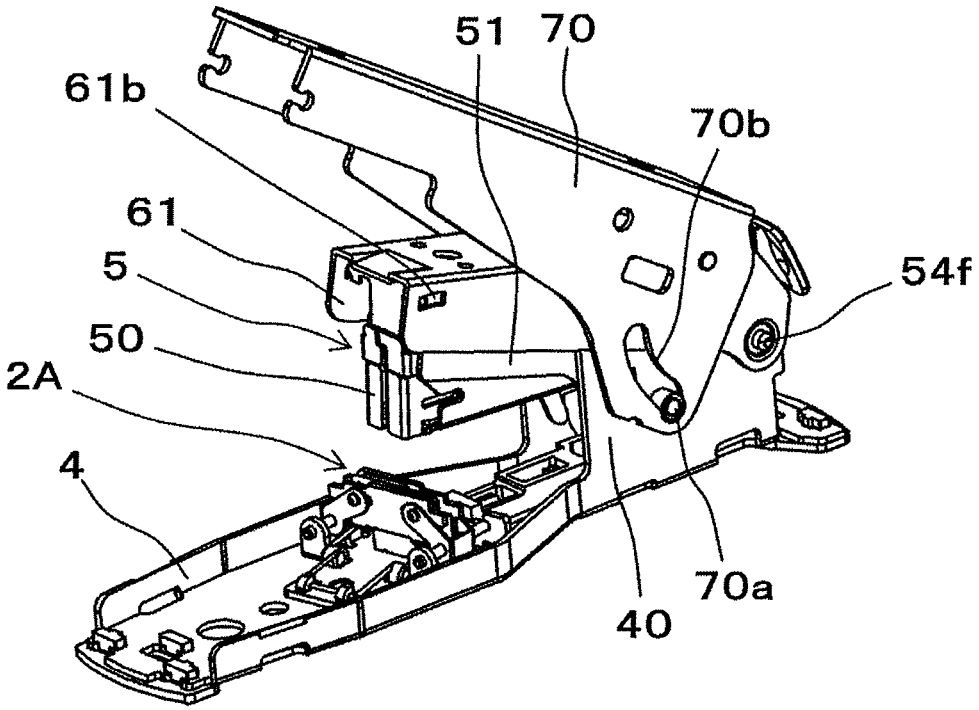
FIG. 5 is a perspective view showing an internal configuration of the stapler according to the exemplary embodiment.
Figure 6:
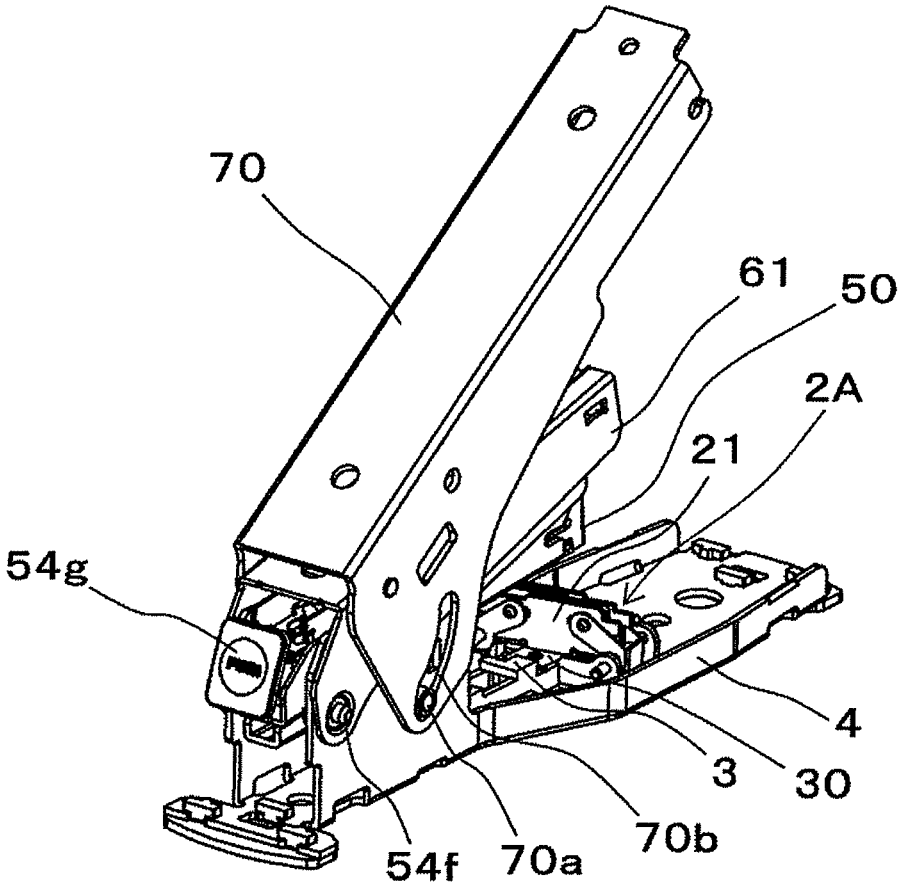
FIG. 6 is a perspective view showing an internal configuration of the stapler according to the exemplary embodiment.
Figure 7:
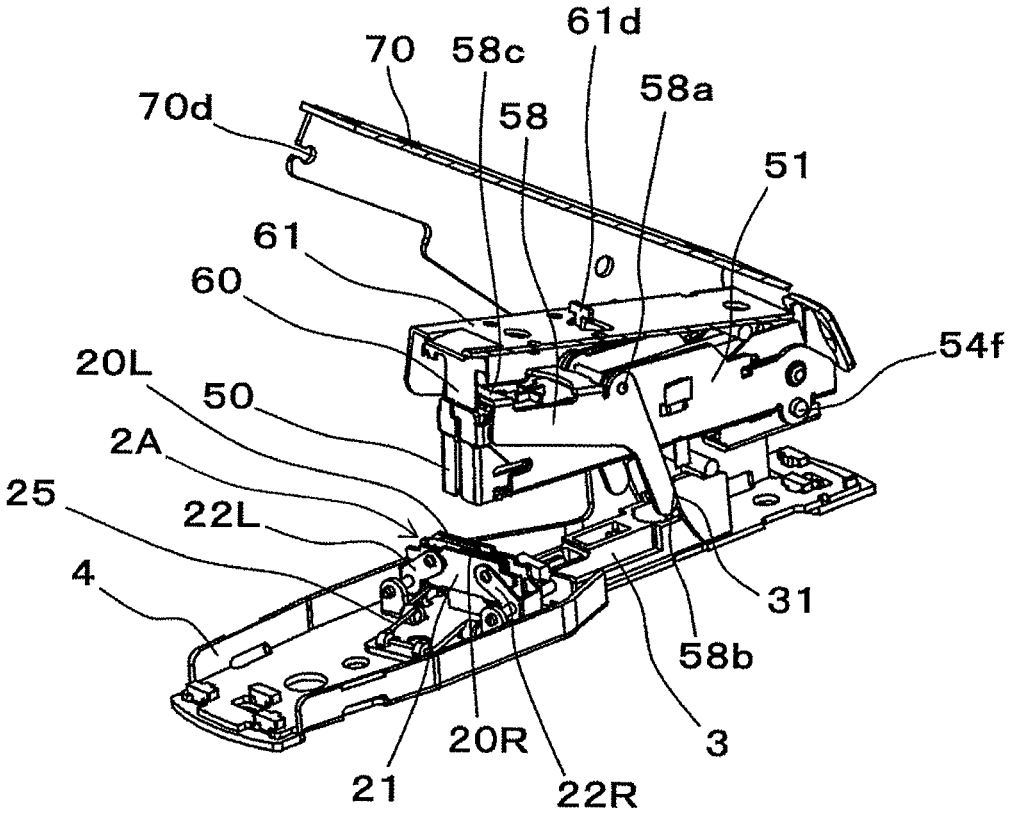
FIG. 7 is a partially broken perspective view showing an internal configuration of the stapler according to the exemplary embodiment.
Figure 8:
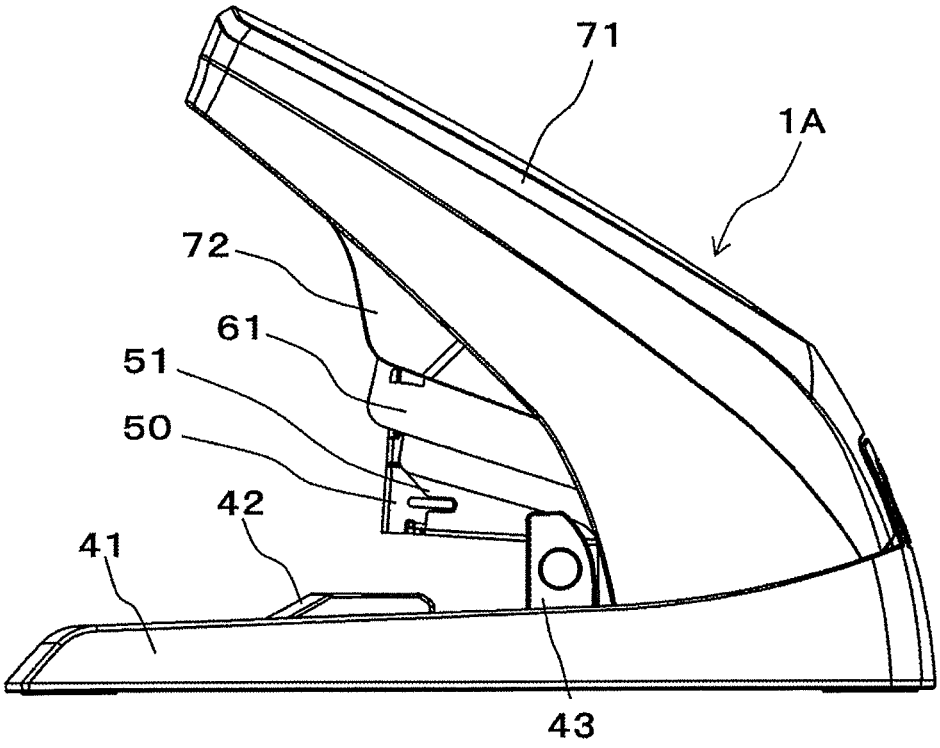
FIG. 8 is a side view showing an outward appearance of the stapler according to the exemplary embodiment.
Figure 9:
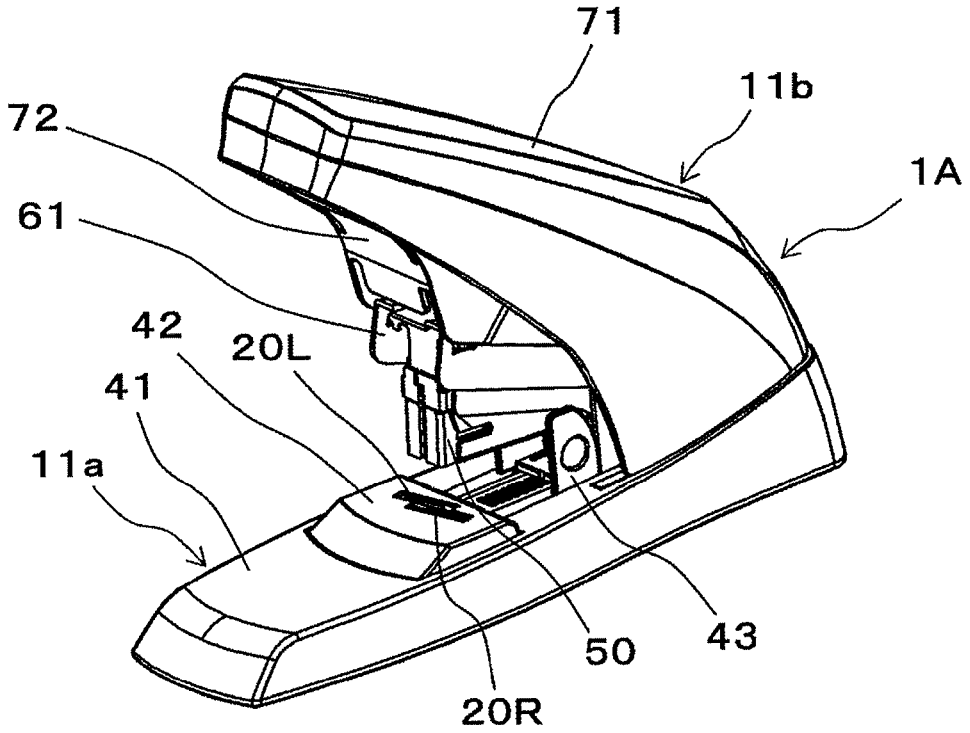
FIG. 9 is a perspective view showing the outward appearance of the stapler according to the exemplary embodiment.
Figure 10:
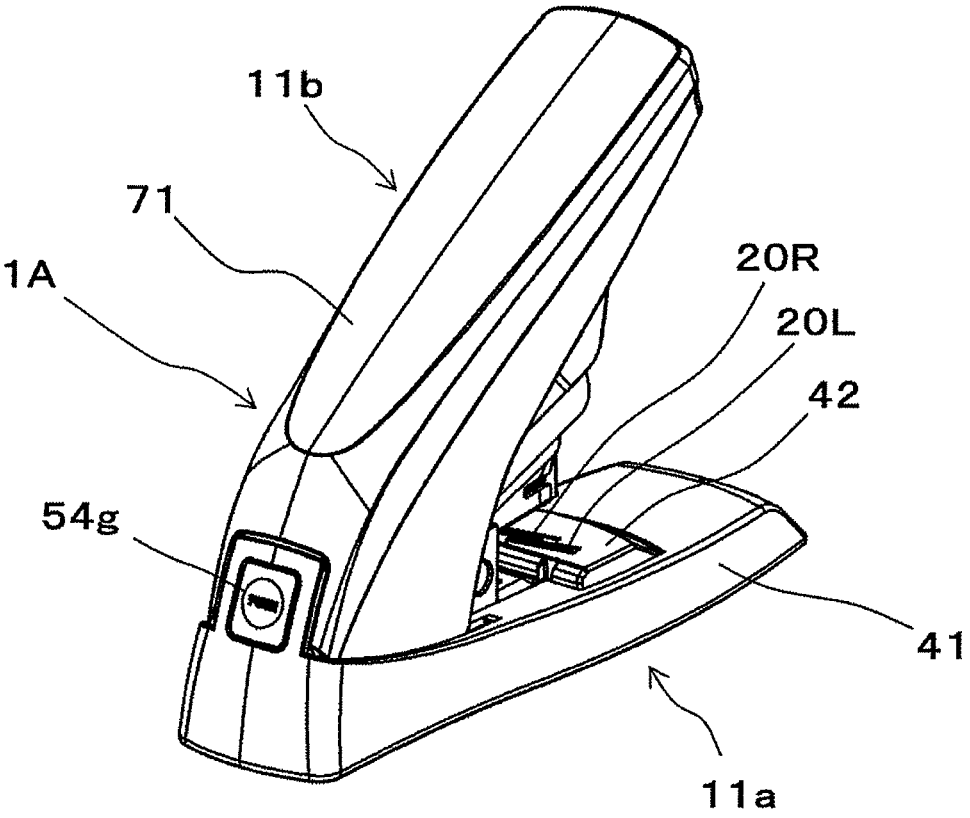
FIG. 10 is a perspective view showing the outward appearance of the stapler according to the exemplary embodiment.

Also, FIGS. 5 and 6 are perspective views showing an internal configuration of the stapler according to the exemplary embodiment, and FIG. 7 is a partially broken perspective view showing an internal configuration of the stapler according to the exemplary embodiment. Also, FIG. 8 is a side view showing an outward appearance of the stapler according to the exemplary embodiment and FIGS. 9 and 10 are perspective views showing an outward appearance of the stapler according to the exemplary embodiment. Also, FIG. 11 illustrates an example of a staple that is used in the stapler of the exemplary embodiment.

<Example of Configuration of Staple That is Used in Stapler of Exemplary Embodiment>

A stapler 1A of an exemplary embodiment enables a staple 10 having long legs, in addition to a conventional staple having short legs, to be used, thereby increasing the number of sheets to be bound.

Figure 11A:
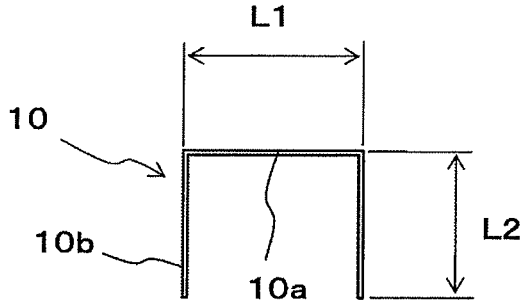
FIGS. 11(*a*) to 11(*c*) illustrate an example of a staple that is used in the stapler of the exemplary embodiment.
Figure 11B:
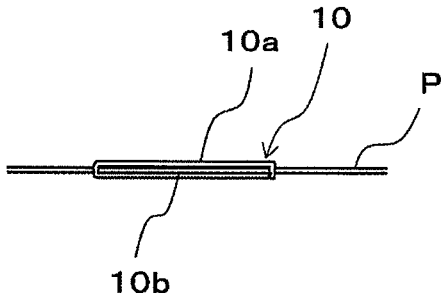
Figure 11C:
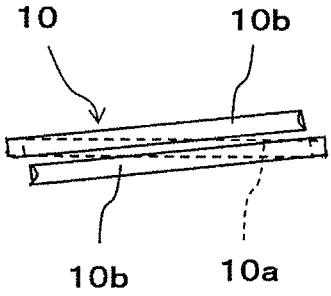

As shown in FIG. 11(*a*), the staple 10 has a staple crown 10*a* and two legs 10*b* that are bent to be substantially parallel from both ends of the staple crown 10*a* in one direction. A plurality of the staples 10 is integrated by bonding, thereby configuring a bundle of staples.

The staple 10 is configured so that a length (outer size) L1 of the staple crown 10*a* is the substantially same as a length L2 of the leg 10*b*. The two legs 10*b* are bent to be offset in a front-rear direction orthogonal to the staple crown 10*a*. Thereby, as shown in FIGS. 11(*b*) and 11(*c*), when binding two sheets P that are the smallest number of sheets to be bound, the two legs 10*b* do not overlap each other and leading ends of the legs 10*b* do not more protrude outward in a width direction than the staple crown 10*a* on a surface of the sheet P.

<Example of Overall Configuration of Stapler of Exemplary Embodiment>

The stapler 1A has a lower handle unit 11*a* and an upper handle unit 11*b*. In this example, the stapler is used in a form of pressing the upper handle unit 11*b* with the lower handle unit 11*a* being put on an operation place such as desk.

Figure 12:
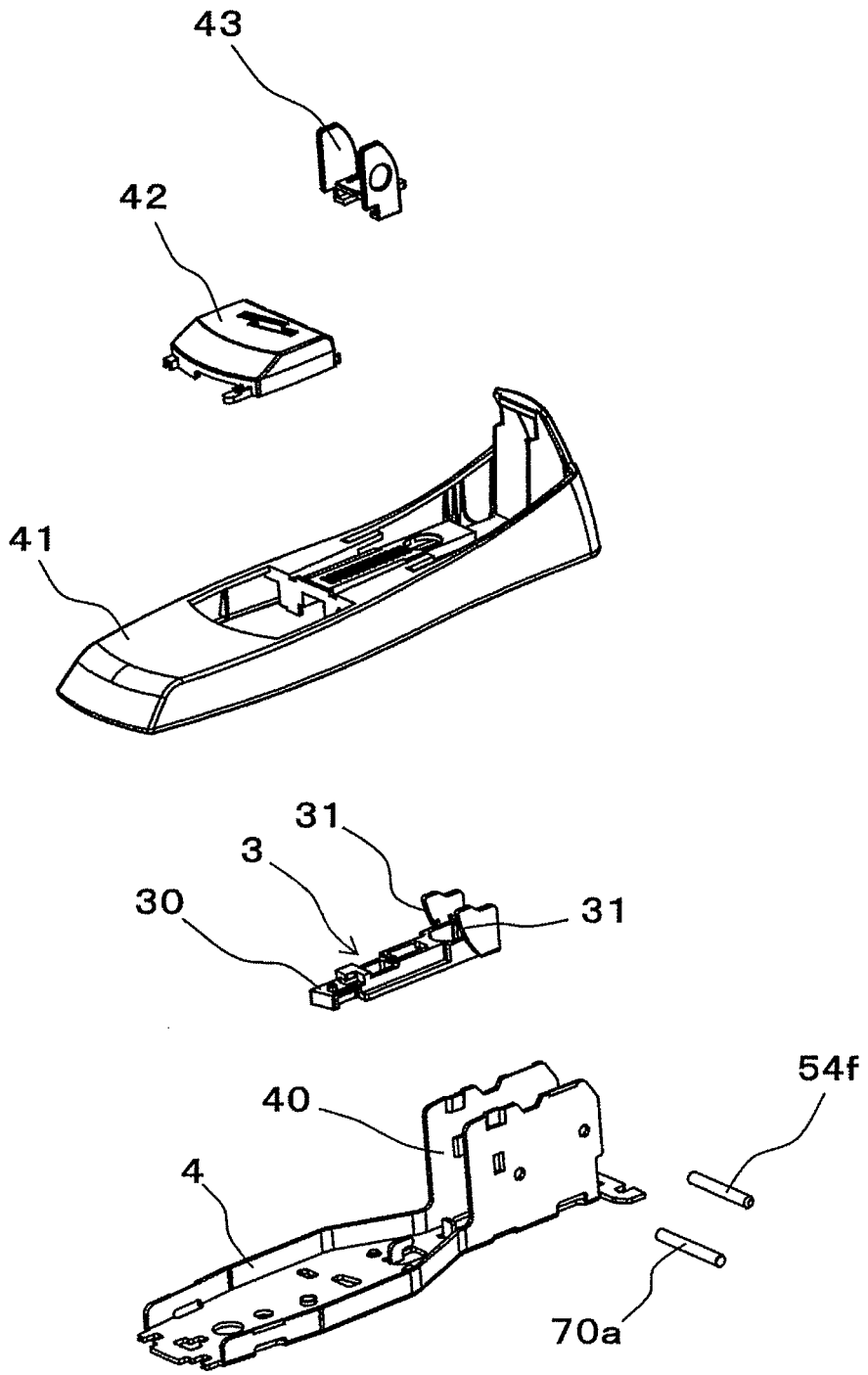
FIG. 12 is an exploded perspective view showing an example of a lower handle unit of the exemplary embodiment.
Figure 13:
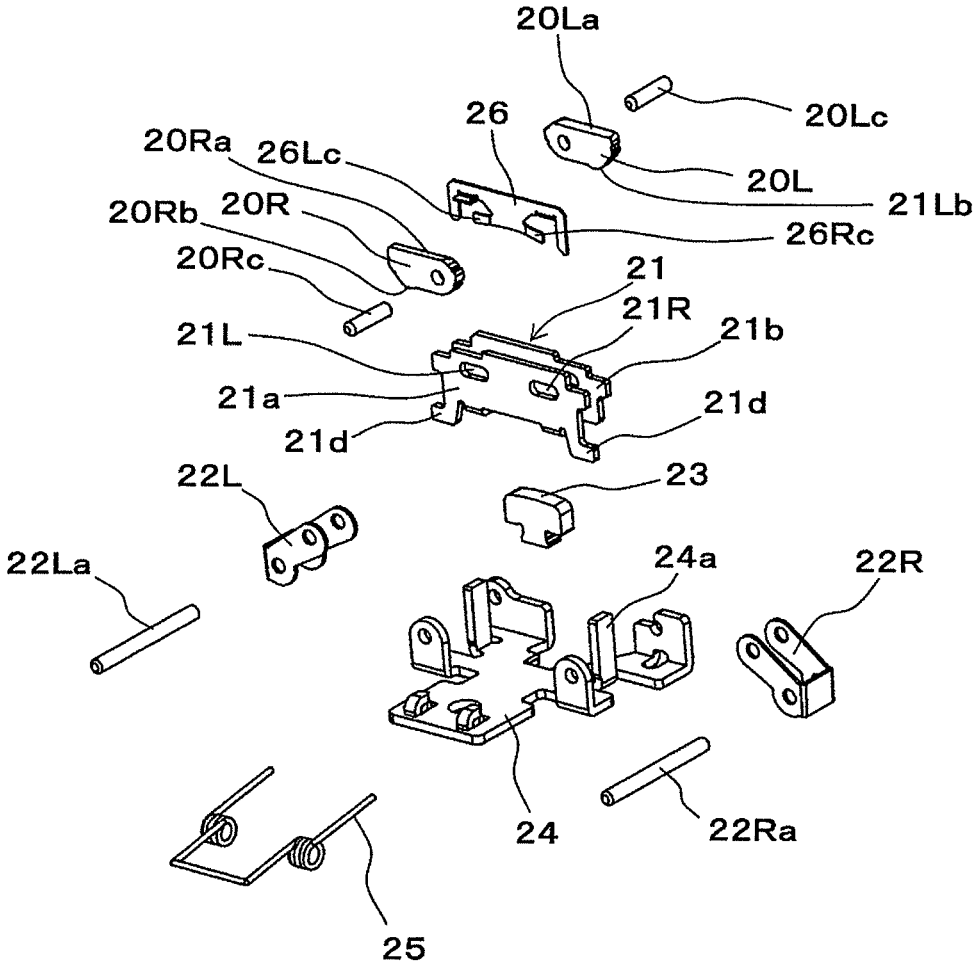
FIG. 13 is an exploded perspective view showing an example of a clincher unit of the exemplary embodiment.

FIG. 12 is an exploded perspective view showing an example of the lower handle unit of the exemplary embodiment and FIG. 13 is an exploded perspective view showing an example of a clincher unit of the exemplary embodiment. The lower handle unit 11*a* has a clincher unit 2A that bends the legs 10*b* of the staple 10 having penetrated the sheets and a slider 3 that performs lock and lock release at a standby position of the clincher unit 2A. Also, the lower handle unit 11*a* has a lower handle frame 4 to which the clincher unit 2A and the slider 3 are attached.

Figure 14:
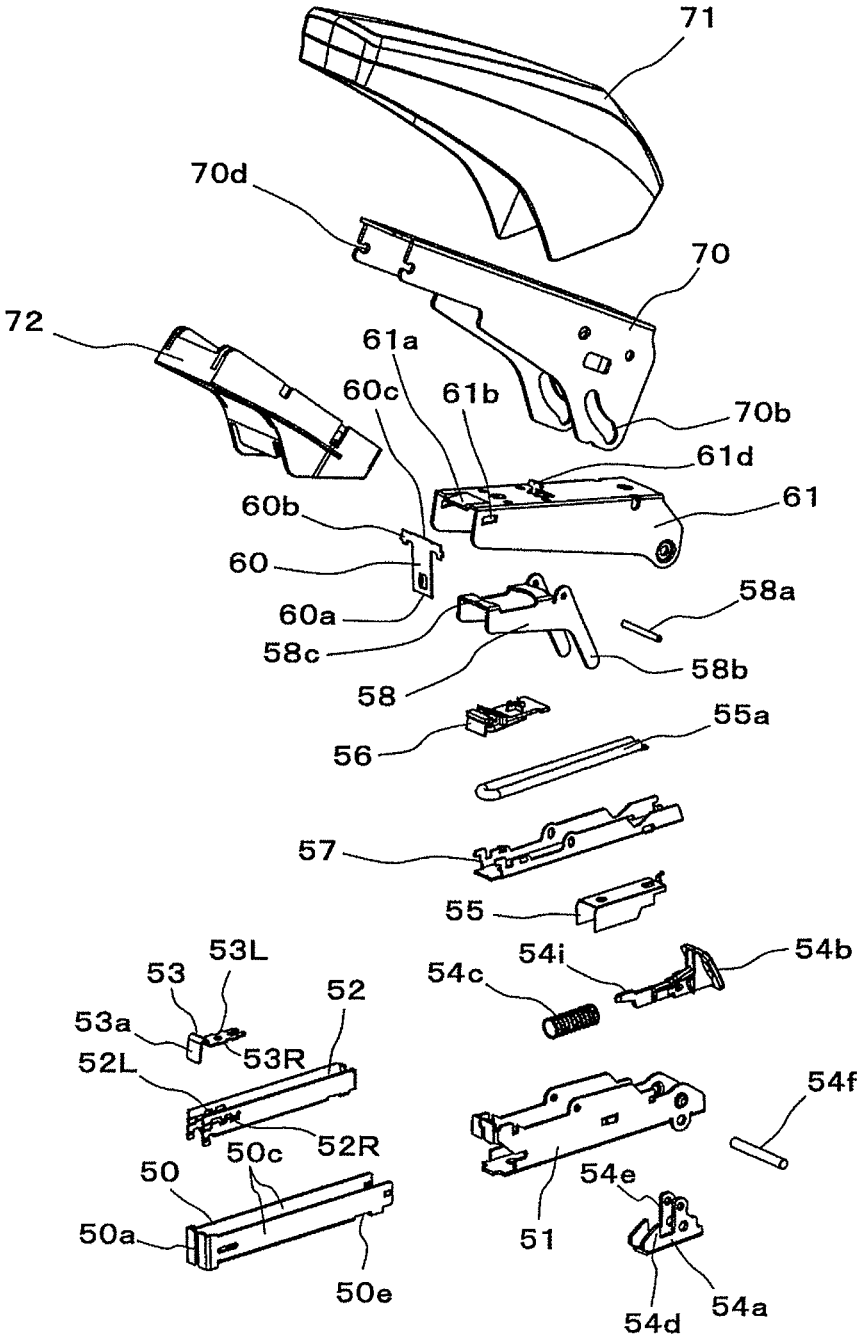
FIG. 14 is an exploded perspective view showing an example of an upper handle unit of the exemplary embodiment.

FIG. 14 is an exploded perspective view showing an example of the upper handle unit of the exemplary embodiment. The upper handle unit llb has a magazine unit 5 in which the staples 10 are accommodated and a driver unit 6 that discharges the staples 10 accommodated in the magazine unit 5. Also, the upper handle unit 11*b* has a handle unit 7 that applies a force of discharging the staples 10 accommodated in the magazine unit 5 to the driver unit 6.

<Example of Configuration of Clincher Unit>

Figure 15:
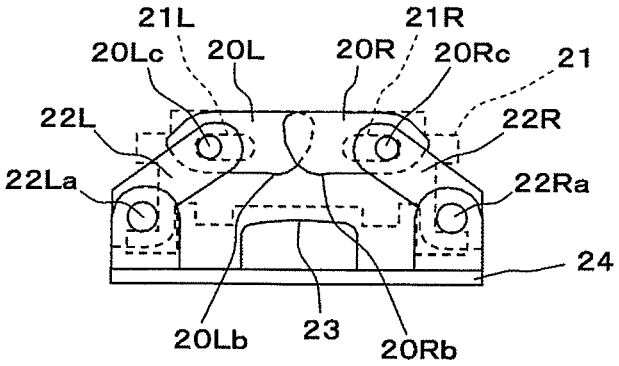
FIG. 15 is a front view showing an example of a clincher unit.
Figure 16:
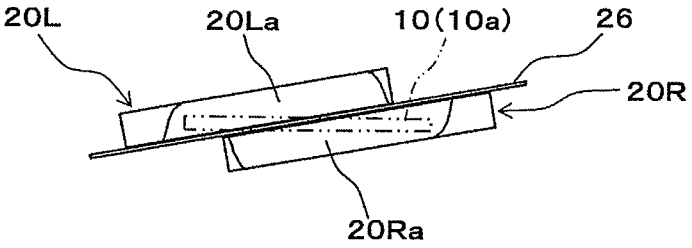
FIG. 16 is a plan view of main parts showing an example of the clincher unit.
Figure 17:
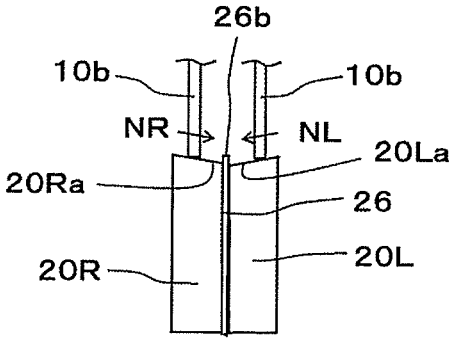
FIG. 17 is a side view of main parts showing an example of the clincher unit.
Figure 18:
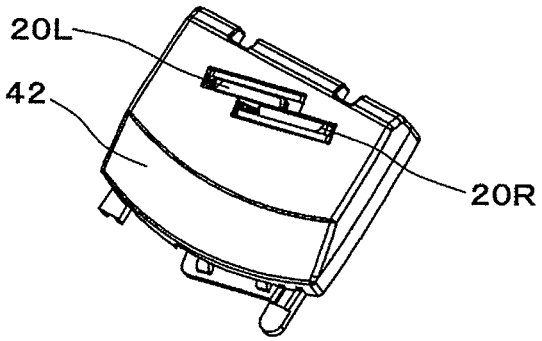
FIG. 18 is an outward perspective view showing an example of the clincher unit.

FIG. 15 is a front view showing an example of the clincher unit, FIG. 16 is a plan view of main parts showing an example of the clincher unit, FIG. 17 is a side view of main parts showing an example of the clincher unit and FIG. 18 is an outward perspective view showing an example of the clincher unit.

Figure 19:
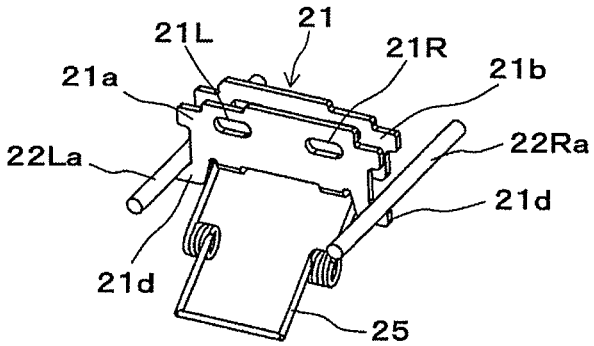
FIG. 19 is a perspective view of main parts showing a configuration of holding the clincher unit at a standby position.
Figure 20:
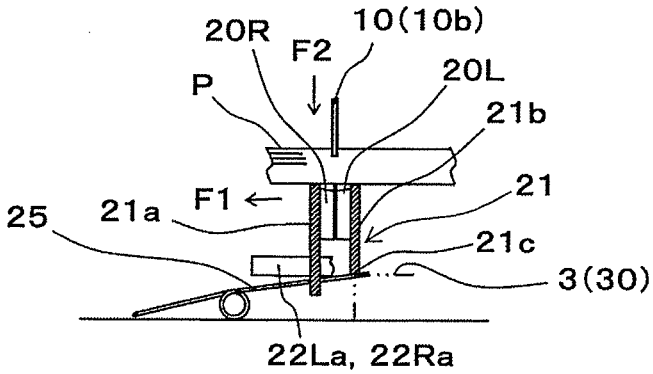
FIG. 20 is a side view of main parts showing a configuration of holding the clincher unit at the standby position.
Figure 21A:
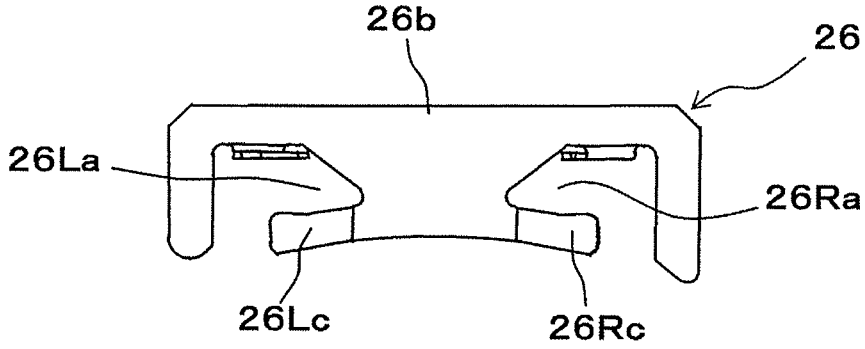
FIGS. 21(*a*) to 21(*c*) are configuration views showing an example of a partition plate for holding clinchers.
Figure 21B:
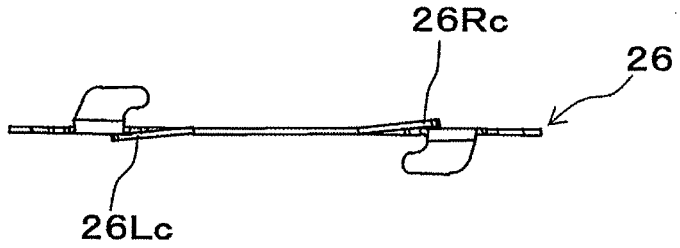
Figure 21C:
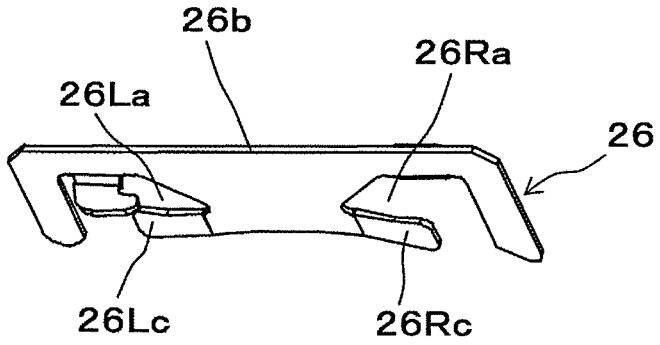

Also, FIG. 19 is a perspective view of mainparts showing a configuration of holding the clincher unit at a standby position, and FIG. 20 is a side view of main parts showing a configuration of holding the clincher unit at the standby position. Also, FIG. 21 is a configuration view showing an example of a partition plate for holding a clincher.

In the below, a configuration of the clincher unit 2A is described with reference to the respective drawings. The clincher unit 2A has a pair of clinchers 20L, 20R that bends the legs 10*b* of the staple 10 having penetrated the sheets and a clincher holder 21 that supports the clincher 20L and the clincher 20R.

The clincher unit 2A has a configuration of bending the legs 10*b* of the staple 10 by rotating operations of the clincher 20L and the clincher 20R, and moves the clincher 20L and the clincher 20R in an approaching direction thereof, as movement of starting to bend the legs 10*b*, thereby applying a force of bending the legs 10*b* inward.

To this end, the clincher unit 2A has a pair of clincher links 22L, 22R serving as a clincher driving mechanism that guides movement of the clincher holder 21 in an ascent and descent direction and guides rotation and movement of the clinchers 20L, 20R in separating/contacting directions. Also, the clincher unit 2A has a clincher support part 23 that pushes up the clinchers 20L, 20R by an ascent and descent operation of the clincher holder 21.

Also, the clincher unit 2A has a clincher frame 24 that rotatably supports the clincher links 22L, 22R and guides the movement of the clincher holder 21 having the clinchers 20L, 20R. attached thereto in the ascent and descent direction. Also, the clincher unit 2A has a return spring 25 that pushes up the clincher holder 21 and a partition plate 26 that partitions the clincher 20L and the clincher 20R. therebetween and holds directions of the clinchers 20L, 20R.

As shown in FIG. 16, the clincher unit 2A is arranged so that positions of the clincher 20L and the clincher 20R are offset in a left-right direction along the staple crown 10*a* of the staple 10 and in a front-rear direction orthogonal to the staple crown 10*a*.

The clincher 20L is disposed to face one leg 10*b* of the staple 10 and is formed on an upper surface facing the leg 10*b* with a clincher surface 20La that is inclined in a downward direction toward the clincher 20R arranged to be offset in the front-rear direction, as shown in FIG. 17. Also, the clincher 20L is formed with a pressing surface 20Lb, which is pressed by the clincher support part 23, on a lower surface of one end portion facing the clincher support part 23.

The clincher 20L is configured so that the other end portion thereof is rotatably supported to an upper end side of the clincher link 22L by a shaft 20Lc and is moveably supported to the clincher holder 21 in rotating and horizontal directions.

The clincher 20R is disposed to face the other leg 10*b* of the staple 10 and is formed on an upper surface facing the leg lob with a clincher surface 20Ra that is inclined in a downward direction toward the clincher 20L arranged to be offset in the front-rear direction, as shown in FIG. 17. Also, the clincher 20R is formed with a pressing surface 20Rb, which is pressed by the clincher support part 23, on a lower surface of one end portion facing the clincher support part 23.

The clincher 20R is configured so that the other end portion thereof is rotatably supported to an upper end side of the clincher link 22R by a shaft 20Rc and is moveably supported to the clincher holder 21 in rotating and horizontal directions.

The clincher holder 21 has a front holder 21*a* and a rear holder 21*b* along the front-rear direction orthogonal to the staple crown 10*a* of the staple 10. In the clincher holder 21, the front holder 21*a* and the rear holder 21*b* face each other so that a space into which the clincher 20L and the clincher 20R overlapping each other with the partition plate 26 being interposed therebetween are inserted is formed. In this example, the clincher holder 21 has the front holder 21*a* and the rear holder 21*b* that are formed by bending a plate material.

In the clincher holder 21, the front holder 21*a* and the rear holder 21*b* are formed with a guide hole 21L into which the shaft 20Lc of the clincher 20L is inserted and a guide hole 21R into which the shaft 20Rc of the clincher 20R is inserted. The guide hole 21L and the guide hole 21R are long holes that extend in the horizontal direction along the separating/contacting directions of the clincher 20L and the clincher 20R.

The clincher holder 21 rotatably supports the clincher 20L and moveably supports the same in the separating/contacting directions with respect to the clincher 20R by inserting the shaft 20Lc of the clincher 20L into the guide hole 21L. Also, the clincher holder 21 rotatably supports the clincher 20R and moveably supports the same in the separating/contacting directions with respect to the clincher 20L by inserting the shaft 20Rc of the clincher 20R into the guide hole 21R.

In the clincher holder 21, the rear holder 21*b* that is positioned at the rear of the clinchers 20L, 20R and on which the slider 3 abuts is formed with bearing parts 21*c* to which the pushing up force of the return spring 25 is applied. The bearing parts 21*c* are formed on lower surfaces of left and right sides of the rear holder 21*b* and are pushed up from the lower by the abutting return spring 25.

Also, in the clincher holder 21, the front holder 21*a* that is positioned at the front of the clinchers 20L, 20R is formed with height restraint parts 21*d* restraining the movement by the pushing up of the return spring 25. The height restraint parts 21*d* are formed to protrude laterally from left and right sides of the front holder 21*a*.

The clincher link 22L is rotatably supported, at a lower end side thereof, to the clincher frame 24 by the shaft 22La, and the clincher 20L is rotatably supported to an upper end side thereof by the shaft 20Lc.

The clincher 20L and the clincher link 22L are configured so that the shaft 20Lc is moveably inserted into the guide hole 21L of the clincher holder 21 along the long hole shape of the guide hole 21L.

The clincher link 22R is rotatably supported, at a lower end side thereof, to the clincher frame 24 by the shaft 22Ra, and the clincher 20R is rotatably supported to an upper end side thereof by the shaft 20Rc.

The clincher 20R and the clincher link 22R are configured so that the shaft 20Rc is moveably inserted into the guide hole 21R of the clincher holder 21 along the long hole shape of the guide hole 21R.

Thereby, the clincher link 22L rotatably supports the clincher 20L and moves the clincher 20L in the separating/contacting directions with respect to the clincher 20R by the ascent and descent operation of the clincher holder 21. The clincher link 22R rotatably supports the clincher 20R and moves the clincher 20R in the separating/contacting directions with respect to the clincher 20L by the ascent and descent operation of the clincher holder 21.

The clincher support part 23 is introduced between the front holder 21*a* and the rear holder 21*b* by the descent operation of the clincher holder 21 and is then attached to the clincher frame 24 at a position of pressing the clincher 20L and the clincher 20R.

The clincher frame 24 is configured so that the clincher link 22L is rotatably supported at one side thereof in the left-right direction by the shaft 22La and the clincher link 22R is rotatably supported at the other side thereof in the left-right direction by the shaft 22Ra.

The clincher frame 24 has a clincher guide 24*a* that guides the ascent and descent operation of the clincher holder 21. The clincher guide 24*a* has a width corresponding to the space between the front holder 21*a* and the rear holder 21*b* of the clincher holder 21 and is provided between the front holder 21*a* and the rear holder 21*b*. Thereby, while the forward and rearward inclination of the clincher holder 21 is suppressed, the ascent and descent operation of the clincher holder 21 is guided.

The clincher link 22L and the clincher link 22R are supported at the upper end sides thereof to the clincher holder 21 at an interval narrower than the lower end sides thereof supported to the clincher frame 24. The clincher link 22L is rotated about the shaft 22La serving as a fulcrum by the ascent and descent operation of the clincher holder 21 and the clincher link 22R is rotated about the shaft 22Ra serving as a fulcrum by the ascent and descent operation of the clincher holder 21.

By the ascent and descent operation of the clincher holder 21, the clincher link 22L and the clincher link 22R are kept constant while the interval at the lower end sides between the shaft 22La and the shaft 22Ra is not changed. Compared to this, the interval at the upper end sides between the shaft 22La and the shaft 22Ra is changed.

That is, the clincher link 22L and the clincher link 22R are configured so that the interval at the upper end sides is narrower than that at the lower end sides. Thereby, the clincher link 22L is rotated about the shaft 22La serving as a fulcrum by the descent operation of the clincher holder 21 so that the upper end side thereof comes close to the clincher link 22R. Also, the clincher link 22R is rotated about the shaft 22Ra serving as a fulcrum by the descent operation of the clincher holder 21 so that the upper end side thereof comes close to the clincher link 22L.

Also, the clincher link 22L is rotated about the shaft 22La serving as a fulcrum by the ascent operation of the clincher holder 21 so that the upper end side becomes more distant from the clincher link 22R. Also, the clincher link 22R is rotated about the shaft 22Ra serving as a fulcrum by the ascent operation of the clincher holder 21 so that the upper end side becomes more distant from the clincher link 22L.

By the descent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is narrowed.

Hence, by the descent operation of the clincher holder 21, the clincher 20L and the clincher 20R are moved in the approaching direction each other.

Also, by the ascent operation of the clincher holder 21, in the clincher link 22L, the shaft 20Lc is moved along the guide hole 21L, and the clincher link 22R, the shaft 20Rc is moved along the guide hole 21R, so that the interval between the shaft 20Lc and the shaft 20Rc is widened. Hence, by the ascent operation of the clincher holder 21, the clincher 20L and the clincher 20R are moved in the getting away direction each other.

In the below, a configuration of holding the clincher unit at the standby position is described with reference to the respective drawings. The return spring 25 consists of a torsion coil spring, in this example, and a front end side that is one end portion is fixed to the clincher frame 24. Also, as shown in FIG. 20, the return spring 25 is configured so that one end portion at the rear end side abuts on one bearing 21*c* of the rear holder 21*b* of the clincher holder 21 and the other end portion at the rear end side thereof abuts on the other bearing 21*c* of the rear holder 21*b*.

As shown in FIG. 19, the clincher holder 21 is configured so that the one height restraint part 21*d* of the front holder 21*a* abuts on the shaft 22La supporting the clincher link 22L to the clincher frame 24. Also, the clincher holder 21 is configured so that the other height restraint part 21*d* of the front holder 21*a* abuts on the shaft 22Ra supporting the clincher link 22R to the clincher frame 24.

Thereby, in the clincher holder 21, the substantially uniform force is applied to the bearing parts 21*c* at the left and right sides by the return spring 25, so that the rear holder 21*b* is pushed up. Also, the height restraint parts 21*d* at the left and right sides restrain the front holder 21*a* from being pushed up and moved due to the return spring 25.

In the clincher holder 21, the rear holder 21*b* positioned at the rear of the clinchers 20L, 20R is pushed up by the return spring 25 and the front holder 21*a* positioned at the front of the clinchers 20L, 20R is restrained from moving upward by the shafts 22La, 22Ra.

Thereby, the clincher holder 21 having the clinchers 20L, 20R attached thereto keeps a state thereof where it is inclined forward at the standby state where the clincher holder is pushed up by the return spring 25. Meanwhile, in this exemplary embodiment, the return spring 25 is disposed at the front of the clincher unit 2A. However, a configuration is also possible in which the return spring is disposed at the rear of the clincher unit 2A and the force is applied to the rear holder 21*b*.

In the below, a configuration of holding the clinchers 20L, 20R at the standby state is described with reference to the respective drawings.

The partition plate 26 has a shaft bearing part 26La into which the shaft 20Lc of the clincher 20L is inserted and a shaft bearing part 26Ra into which the shaft 20Rc of the clincher 20R is inserted.

The partition plate 26 is inserted between the clincher 20L and the clincher 20R and is supported to the shaft 20Lc and the shaft 20Rc. The shaft bearing parts 26La, 26Ra are configured by long hole shapes corresponding to the movement of the shafts 20Lc, 20Rc accompanied by the movement of the clinchers 20L, 20R in the separating/contacting direction.

The partition plate 26 has a partition part 26*b* protruding upward from the clincher surface 20La of the clincher 20L and the clincher surface 20Ra of the clincher 20R at the standby state. Also, the partition plate 26 has a spring part 26Lc bent toward the clincher 20L and a spring part 26Rc bent toward the clincher 20R.

A side surface of the clincher 20L is pressed by the spring part 26Lc of the partition plate 26 and a side surface of the clincher 20R is pressed by the spring part 26Rc of the partition plate 26, so that the clincher 20L and the clincher 20R are held with respect to the directions at the standby state.

<Example of Configuration of Lower Handle Unit>

Subsequently, a configuration of the lower handle unit 11*a* is described with reference to the respective drawings. In the lower handle unit 11*a*, the lower handle fame 4 consists of a plate and the like. In the lower handle frame 4, the clincher frame 24 configuring the clincher unit 2A is attached to the front. Also, in the lower handle frame 4, the slider 3 is attached to the rear of the clincher unit 2A. Also, the lower handle frame 4 is formed with an upper handle attachment part 40 to which the upper handle unit 11*b* is attached.

The slider 3 is formed with an engaging part 30 at the front side facing the clincher unit 2A and with a link bearing part 31 at the rear side. The slider 3 is configured to slide in the front-rear direction, is attached to the lower handle frame 4 and is pressed by a spring (not shown), so that it is moved forward up to a position at which the rear holder 21*b* of the clincher holder 21 configuring the clincher unit 2A is put on the engaging part 30. Also, as the slide 3 is moved rearward, the engaging part 30 is separated from the rear holder 21*b* of the clincher holder 21.

In the lower handle unit 11*a*, a lower handle cover 41 having a shape covering the lower handle frame 4 is attached to the lower handle frame 4 to which the clincher unit 2A and the slide 3 are attached.

Also, in the lower handle unit 11*a*, a clincher cover 42 covering the clincher unit 2A is attached to the lower handle cover 41. The clincher cover 42 has an opening through which the clincher 20L and the clincher 20R configuring the clincher unit 2A, the partition plate 26 interposed between the clinchers 20L, 20R and the clincher holder 21 having the clinchers 20L, 20R attached thereto are exposed. The clincher cover 42 is configured to ascend and descend as the clincher holder 21 ascends and descends and is attached to the lower handle cover 41.

Also, in the lower handle unit 11*a*, a sheet guide 43 that restrains a position of a sheet is attached to the lower handle cover 41. The sheet guide 43 is configured to slide in the front-rear direction and is attached to the lower handle cover 41. The sheet collides with the sheet guide 43, so that a position to be bound by the staple 10 is adjusted.

<Example of Configuration of Magazine Unit>

As shown in FIG. 14, the magazine unit 5 has a magazine 50 into which the staples 10 are loaded and a magazine guide 51 accommodating the magazine 50 so that the magazine can be withdrawn for loading of the staples 10.

Figure 22:
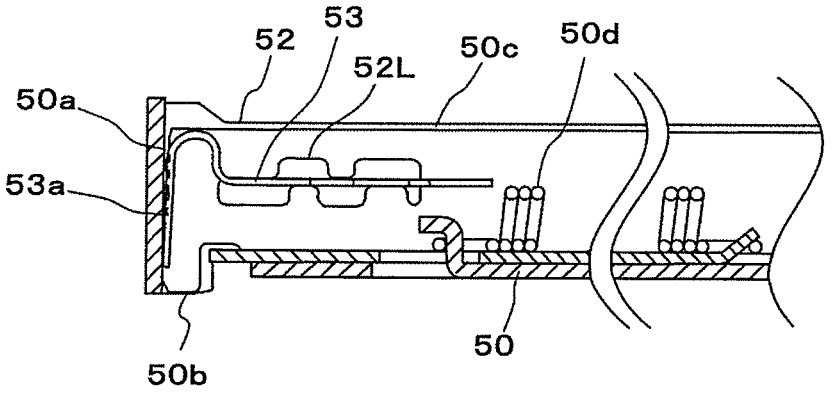
FIG. 22 is a side sectional view of main parts showing an example of a magazine.
Figure 23:
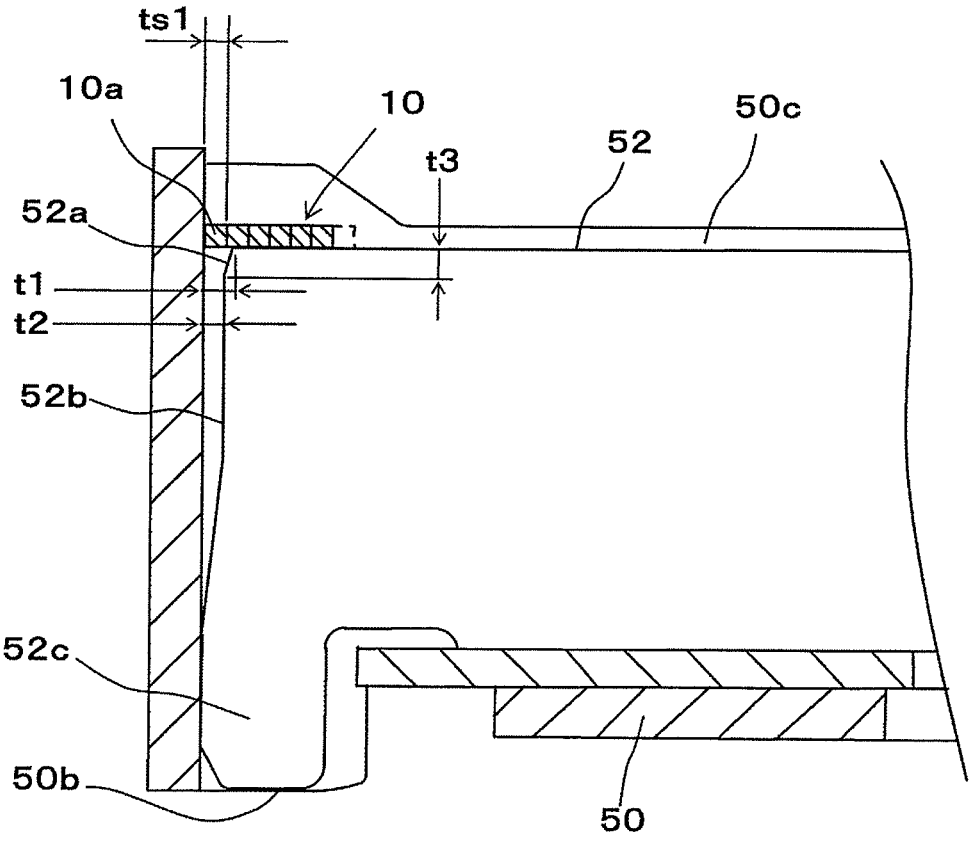
FIG. 23 is a side sectional view of main parts showing an example of the magazine.
Figure 24:
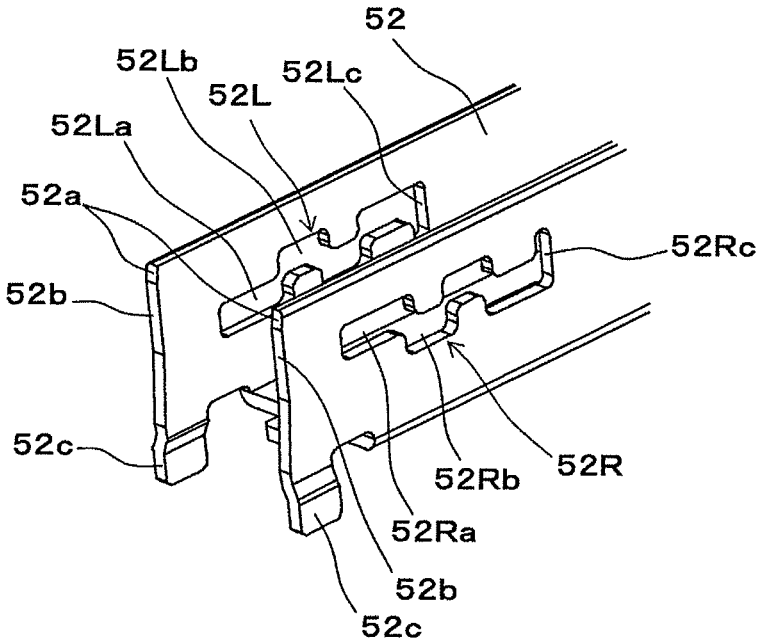
FIG. 24 is a perspective view of main parts showing an example of a staple guide.
Figure 25:
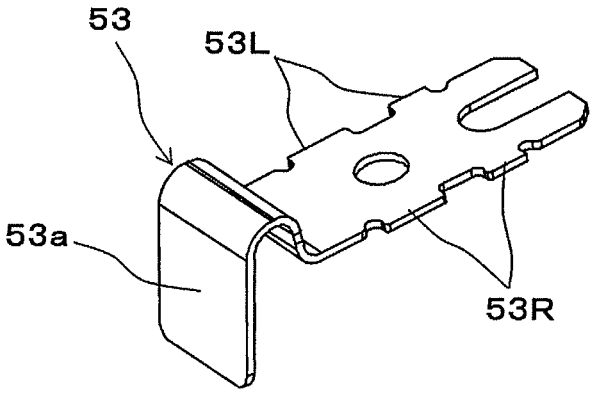
FIG. 25 is a perspective view showing an example of a staple holder.

FIGS. 22 and 23 are side sectional views of main parts showing an example of the magazine, FIG. 24 is a perspective view of main parts showing an example of a staple guide and FIG. 25 is a perspective view showing an example of a staple holder. In the below, a configuration of the magazine 50 is described with reference to the respective drawings.

The magazine 50 has a staple guide 52 that guides the staple 10 and a staple holder 53 that holds a shape of one separated staple 10 discharged by the driver unit 6.

The magazine 50 is opened at its upper surface, so that a space capable of loading the staples 10 is formed. The magazine is formed, at a lower part of a magazine front wall 50*a* to which the staple 10 is pressed, with an opening 50*b* having a size through which the one separated staple 10 can pass. Also, the magazine 50 is configured so that inner sizes of magazine sidewalls 50*c* facing each other are slightly wider than the outer size of the staple crown 10*a* of the staple 10.

The staple guide 52 is attached to the inner space of the magazine 50. A coil spring 50*d* is attached between the magazine 50 and the staple guide 52, so that the staple guide 52 is pressed toward the magazine front wall 50*a*.

The staple guide 52 is configured to be slightly narrower than the inner size of the staple crown 10*a* of the staple 10. A space into which the legs 10*b* of the staple 10 can be inserted is formed between the magazine sidewalls 50*c* and the staple guide 52.

As shown in FIG. 23, the staple guide 52 has shear guide parts 52*a* that apply a shear force for separating the staples 10 one by one, pressing guide parts 52*b* that press the one separated staple 10 to the magazine front wall 50*a* and width guide parts 52*c* that guide the legs 10*b* of the staple 10 in the width direction.

The shear guide part 52*a* is formed with an inclined surface between a front end upper surface of the staple guide 52 and the magazine front wall 50*a*, which inclined surface has an interval t1 wider than a line width ts1 of one staple 10 and narrower than a line width of two staples 10.

The pressing guide part 52*b* is configured so that an interval t2 between the magazine front wall 50*a* and the pressing guide part is lightly narrower than the line width of one staple 10 at a state where the width guide part 52*c* abuts on the magazine front wall 50*a*. The staple 10 passing between the pressing guide part 52*b* and the magazine front wall 50*a* is pressed to the magazine front wall 50*a* by the pressing guide part 52*b*.

Here, regarding a case where the staple 10 having the long legs 10*a* as shown in FIG. 11(*a*) is used, a height t3 of the shear guide part 52*a* is set so that the staple crown 10*a* is guided by the pressing guide part 52*b* before the leading ends of the legs 10*b* reach the sheet.

The width guide part 52*c* has a size that is slightly smaller than the line width of the one staple 10, and protrudes forward from the pressing guide part 52*b*. Also, as shown in FIG. 24, the pair of width guide parts 52*c* is configured to have the substantially same width as the inner size of the staple crown 10*a* of the staple 10 and protrudes leftward and rightward from the staple guide 52.

The staple holder 53 has a staple crown guide part 53*a* that keeps a shape of the staple crown 10*a* of the one separated staple 10. The staple holder 53 is attached to the front end portion of the staple guide 52. At this time, the staple crown guide part 53*a* is arranged between the pair of left and right pressing guide parts 52*b* and the staple crown guide part 53*a* faces the magazine front wall 50*a* of the magazine 50.

In the staple holder 53, the staple crown guide part 53*a* is inclined in a direction along which the gap between the staple crown guide part 53*a* and the magazine front wall 50*a* is narrowed from the upper end side of the staple crown guide part 53*a* toward the lower end side thereof, and a lower end of the staple crown guide part 53*a* contacts the magazine front wall 50*a*.

The staple holder 53 is made of an elastic material. When the one separated staple 10 passes between the magazine front wall 50*a* and the staple guide 52, the staple holder 53 is pressed by the staple crown 10*a* and the staple crown guide part 53*a* is thus elastically deformed, so that the force of pushing up the staple crown 10*a* is applied and the deformation of the staple crown 10*a* is thus suppressed.

Figure 26A:
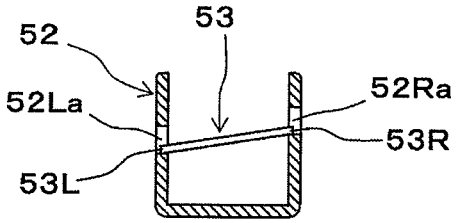
FIGS. 26 (*a*) and 26 (*b*) are front sectional views showing an attachment example of the staple holder.
Figure 26B:
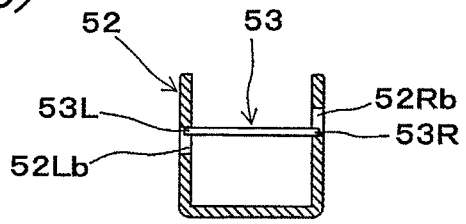
Figure 27A:
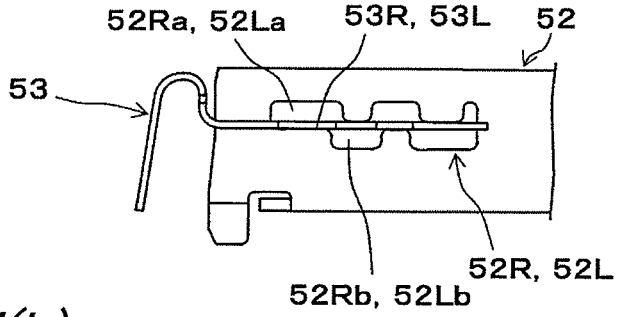
FIGS. 27 (*a*) and 27 (*b*) are side sectional views showing the attachment example of the staple holder.
Figure 27B:
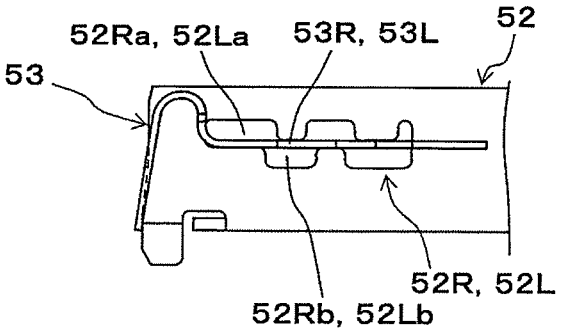

FIG. 26 is a front sectional view showing an attachment example of the staple holder and FIG. 27 is a side sectional view showing an attachment example of the staple holder. In the below, a configuration of attaching the staple holder 53 is described with reference to the respective drawings. The staple holder 53 is formed with an attaching convex part 53L at one side in the width direction and with an attaching convex part 53R at the other side.

The staple holder 53 is preferably configured so that two or more are provided regarding the one of the attaching convex part 53L and the attaching convex part 53R and one or more are provided regarding the other. In this example, the attaching convex parts 53L and the attaching convex parts 53R are symmetrically arranged at two locations of the respective left and right sides of the staple holder 53 so that they protrude laterally.

The staple guide 52 is formed with an attaching opening 52L, into which the attaching convex parts 53L of the staple holder 53 are inserted, at one side in the width direction and with an attaching opening 52R, into which the attaching convex parts 53R of the staple holder 53 are inserted, at the other side.

The staple guide 52 and the staple holder 53 are configured so that the attaching convex parts 53L, 53R of the staple holder 53 are inserted into the attaching openings 52L, 52R of the staple guide 52 at predetermined insertion positions and the staple holder 53 is moved to a fixing position to fix the staple holder 53 to the staple guide 52.

To this end, the attaching opening 52L has insertion openings 52La into which the attaching convex parts 53L of the staple holder 53 at the insertion position are inserted by an operation of attaching the staple holder 53 to the staple guide 52.

Also, the attaching opening 52L has support convex parts 52Lb that support the attaching convex parts 53L of the staple holder 53 at the fixing position by an operation of moving the staple holder rearward with respect to the staple guide 52. Further, the attaching opening 52L has a position restraint part 52Lc that restrains a position of the staple holder 53 at the fixing position between the magazine front wall 50*a* of the magazine 50 and the staple holder 53.

The attaching opening 52R has insertion openings 52Ra into which the attaching convex parts 53R of the staple holder 53 at the insertion position are inserted by the operation of attaching the staple holder 53 to the staple guide 52.

Also, the attaching opening 52R has support convex parts 52Rb that support the attaching convex parts 53R of the staple holder 53 at the fixing position by the operation of moving the staple holder rearward with respect to the staple guide 52. Further, the attaching opening 52R has a position restraint part 52Rc that restrains a position of the staple holder 53 at the fixing position between the magazine front wall 50*a* of the magazine 50 and the staple guide.

The attaching opening 52L has the insertion openings 52La that are formed at two locations and the support convex parts 52Lb that are formed at three locations, in correspondence to the arrangement of the two attaching convex parts 53L of the staple holder 53. The insertion openings 52La and the support convex parts 52Lb are alternately arranged and connected in the front-rear direction of the staple guide 52 and the position restraint part 52Lc is formed at a rear end of the attaching opening 52L.

Likewise, the attaching opening 52R has the insertion openings 52Ra that are formed at two locations and the support convex parts 52Rb that are formed at three locations, in correspondence to the arrangement of the two attaching convex parts 53R of the staple holder 53. The insertion openings 52Ra and the support convex parts 52Rb are alternately arranged and connected in the front-rear direction of the staple guide 52 and the position restraint part 52Rc is formed at a rear end of the attaching opening 52R.

The attaching opening 52L and the attaching opening 52R are formed so that the insertion openings 52La and the insertion openings 52Ra and the support convex parts 52Lb and the support convex parts 52Rb are symmetrically arranged in the upper-lower direction.

A method of attaching the staple holder 53 is described. As shown in FIG. 26 (*a*), the staple holder 53 is inclined in the left-right direction at the insertion position so that the attaching convex parts 53L, 53R are introduced between the left and right sidewalls of the staple guide 52.

Thereby, the attaching convex parts 53L are inserted into the insertion openings 52La of the attaching opening 52L and the attaching convex parts 53R are inserted into the insertion openings 52Ra of the attaching opening 52R.

The staple holder 53 having the attaching convex parts 53L inserted into the insertion openings 52La and the attaching convex parts 53R inserted into the insertion openings 52Ra is made to be substantially horizontal, as shown in FIG. 26(*b*), so that it can horizontally move rearward.

When the staple holder 53 at the insertion position as shown in FIG. 27 (a) is moved to the fixing position as shown in FIG. 27(*b*), the attaching convex parts 53L, 53R are fitted into the support convex pats 52Lb, 52Rb between the left and right attaching openings 52L, 52R, so that the staple holder 53 is restrained from rotating in an inclining direction.

When the staple guide 52 having the staple holder 53 attached thereto is attached to the magazine 50 and the coil spring 50*d* is attached between the magazine 50 and the staple guide 52, the staple guide 52 is pressed toward the magazine front wall 50*a*.

When the staple guide 52 is pressed toward the magazine front wall 50*a*, the staple crown guide part 53*a* of the staple holder 53 is pressed by the magazine front wall 50*a* and the rear end of the staple holder 53 is pressed by the position restraint parts 52Lc, 52Rc of the attaching openings 52L, 52R.

Thereby, at the state where the staple crown guide part 53*a* is pressed by the magazine front wall 50*a*, the staple holder 53 is restrained from rotating in the inclining direction and moving in the front-rear direction and is fixed to the magazine 50 via the staple guide 52.

Regarding the configuration of attaching the staple holder to the staple guide, according to the prior art, a convex part is formed at a side of the staple holder, an opening into which the convex part of the staple holder is fitted is formed at a sidewall facing the staple guide and the staple guide is bent to attach the staple holder.

However, the staple guide is deformed due to the attachment of the staple holder, so that it may not be possible to secure size precision of a part required in the discharge of the staple, in the clinch and the like.

In this exemplary embodiment, when attaching the staple holder 53 to the staple guide 52, the force of deforming the part is not applied. Thereby, the staple guide 52 and the like are not deformed by the attachment of the staple holder 53, so that it is possible to secure the size precision of a part required in the discharge of the staple, in the clinch and the like In the below, a configuration of the magazine guide 51 is described with reference to the respective drawings. The magazine 50 is opened at its front, upper and rear faces, thereby forming a space in which the magazine 50 can be accommodated to be withdrawn from the front face.

The magazine guide 51 has a lock mechanism 54 that performs lock and lock release of the magazine 50 that is accommodated to be withdrawn. Also, the magazine guide 51 has a pusher 55 that pushes forward the staples 10 loaded in the magazine 50, a pusher spring 55*a* that pushes the pusher 55 and a spring guide 56 that guides the pusher spring 55*a*.

Also, the magazine guide 51 has a guide cover 57 that guides the movement of the magazine 50 in the accommodation and withdrawal directions and also guides the staple 10 pushed by the pusher 55 together with the staple guide 52.

The pusher 55 is attached so that it can be moved in the front-rear direction along the staple guide 52 at the inside of the magazine 50 accommodated in the magazine guide 51. The guide cover 57 is attached on an upper surface of the magazine guide 51 and guides the movement of the magazine 50 in the accommodation and withdrawal directions together with the magazine guide 51. Also, the guide cover guides the staple 10 pushed by the pusher 55 together with the staple guide 52.

The pusher spring 55*a* pushes the pusher 55 toward the magazine front wall 50*a* of the magazine 50. The pusher spring 55*a* is connected to the pusher 55 in a U-shaped arrangement by a spring guide 56 that is accommodated in the guide cover 57 and is attached to a front end side of the magazine guide 51, in this example.

The magazine unit 5 has a link 58 that transmits the movement of the upper handle unit 11*b* to the slider 3 of the lower handle unit 11*a* and thus performs the lock and lock release at the standby position of the clincher unit 2A.

In this exemplary embodiment, the link 58 is rotatably attached to the magazine guide 51 about a shaft 58*a* serving as a fulcrum and has a slider pressing part 58*b* that is formed at one end portion of a substantial L shape and abuts on the link bearing part 31 of the slider 3 and a driver pressing part 58*c* that is formed at the other end portion and is pressed by the driver unit 6.

The link 58 is configured in a weight distribution manner that the slider pressing part 58*b* is rotated by its own weight in a direction of abutting on the link bearing part 31 of the slider 3, and the slider pressing part 58*b* and the link bearing part 31 are kept with being always contacted each other. Thereby, as shown in FIG. 4, the link 58 is configured so that the slider pressing part 58*b* is positioned at the rear of the front end of the upper handle attachment part 40 of the lower handle frame 4.

A binding position of the staple 10 for the sheets is determined by a distance between the clinchers 20L, 20R of the clincher unit 2A and the sheet guide 43. To this end, the slider pressing part 58*b* is configured so that it is positioned at the rear of the front end of the upper handle attachment part 40 of the lower handle frame 4. Thereby, it is possible to set the movement position of the sheet guide 43 up to the front end of the upper handle attachment part 40. Hence, it is possible to lengthen a distance from an end portion of the sheet to a bonding position of the staple 10.

Figure 28A:
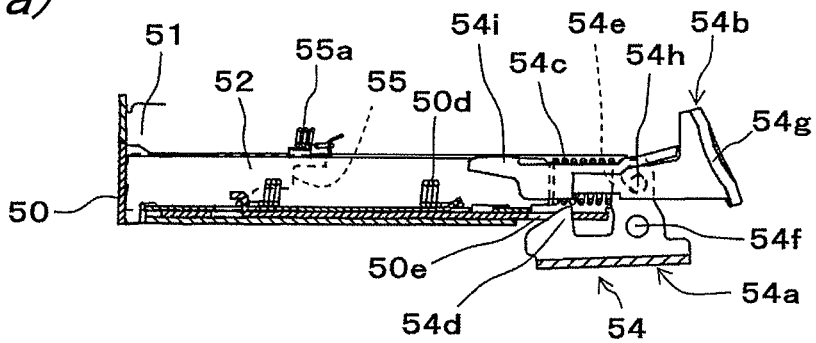
FIGS. 28(*a*) and 28(*b*) are side sectional views showing an example of a lock mechanism.
Figure 28B:
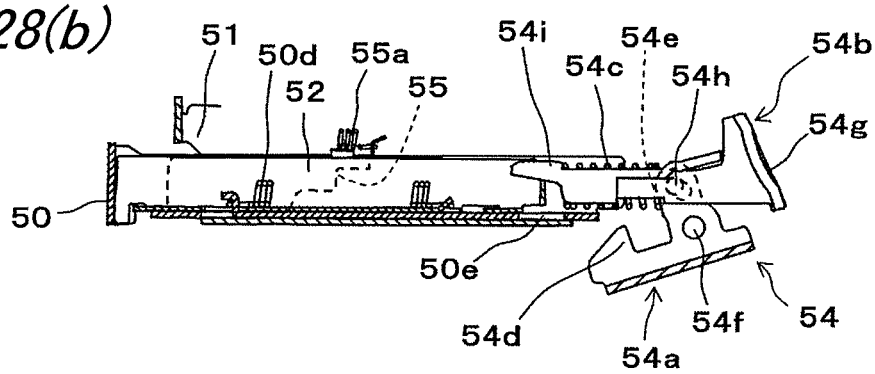
Figure 29:
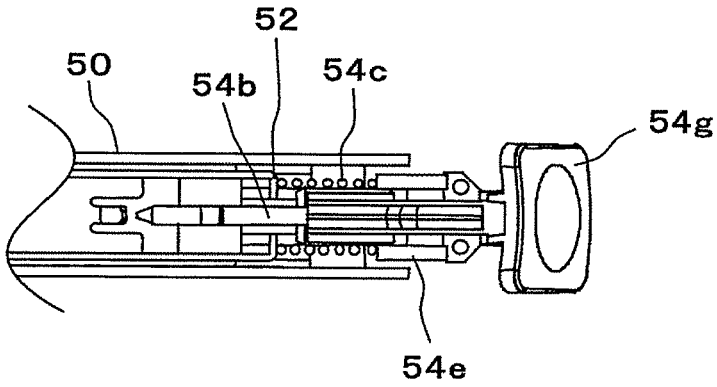
FIG. 29 is a plan sectional view of main parts showing an example of the lock mechanism.

FIG. 28 is a side sectional view showing an example of the lock mechanism and FIG. 29 is a plan sectional view of main parts showing an example of the lock mechanism. In the below, a configuration of the lock mechanism 54 is described with reference to the respective drawings.

The lock mechanism 54 has a magazine stopper 54*a* that locks the magazine 50 at an accommodation position and a pusher switch 54*b* that moves the magazine stopper 54*a*. Also, the lock mechanism 54 has a magazine lock spring 54*c* that applies a force of pressing the magazine 50 in a discharge direction and applies a force of rotating the magazine stopper 54*a* in a lock direction.

The magazine stopper 54*a* has a lock claw 54*d*, which is fitted in a lock opening 50*e* formed on a rear end bottom surface of the magazine 50, at one end portion of a substantial L shape, and has a spring pressing part 54*e*, which is pressed by the magazine lock spring 54*c*, at the other endportion of the substantial L shape. The magazine stopper 54*a* is supported to the magazine guide 51 so that it can be rotated about a shaft 54*f* provided between the lock claw 54*d* and the spring pressing part 54*e*.

The pusher switch 54*b* has a switch part 54*g* at a rear end side thereof, which is pressed by a finger, and is rotatably connected to the other end portion of the substantial L shape to which the spring pressing part 54*e* of the magazine stopper 54*a* is formed, via a shaft 54*h*. The magazine lock spring 54*c* is attached to a front end side of the pusher switch 54*b* with the shaft 54*h* being interposed therebetween.

When the magazine 50 is accommodated in the magazine guide 51, the front end side of the magazine lock spring 54*c* abuts on the staple guide 52 of the magazine 50 and the rear end side thereof abuts on the spring pressing part 54*e* of the magazine stopper 54*a*. At the state where the magazine 50 is withdrawn, the magazine lock spring 54*c* is prevented from being deviated from the pusher switch 54*b* by a deviation preventing convex part 54*i* formed at the front end portion of the pusher switch 54*b*.

At the state where the magazine 50 is accommodated in the magazine guide 51, as shown in FIG. 28(*a*), the magazine lock spring 54 is compressed between the rear end side of the staple guide 52 attached to the magazine 50 and the spring pressing part 54*e* of the magazine stopper 54*a*.

In the magazine stopper 54*a*, the spring pressing part 54*e* is pressed, so that the lock claw 54*d* is rotated about the shaft 54*f* serving as a fulcrum in a direction along which the lock claw 54*d* is fitted into the lock opening 50*e* of the magazine 50 and is thus fitted in the lock opening 50*e*.

Thereby, the magazine 50 is kept with being accommodated in the magazine guide 51. Also, in the magazine 50, the staple guide 52 is pressed by the magazine lock spring 54*c*, so that the staple guide 52 is pressed toward the magazine front wall 50*a* by the magazine lock spring 54*c* together with the coil spring 50*d* attached between the magazine 50 and the staple guide 52.

When the switch part 54*g* is pushed, the pusher switch 54*b* rotates the magazine stopper 54*a* connected via the shaft 54*h* about the shaft 54*f* serving as a fulcrum, thereby separating the lock claw 54*d* of the magazine stopper 54*a* from the lock opening 50*e* of the magazine 50, as shown in FIG. 28(*b*).

When the lock claw 54*d* of the magazine stopper 54*a* is separated from the lock opening 50*e* of the magazine 50, the pusher 55 is pushed by a restoring force of the compressed magazine lock spring 54*c* and a restoring force of the tensioned pusher spring 55*a*, so that the magazine 50 is pressed forward and the magazine 50 is thus withdrawn from the magazine guide 51.

<Example of Configuration of Driver Unit>

In the below, a configuration of the driver unit 6 is described with reference to the respective drawings. The driver unit 6 has a driver 60 that presses one head staple of the staples 10 loaded in the magazine 50 and enables the one staple to penetrate the sheets and a driver arm 61 that presses the driver 60 and the link 58.

The driver 60 consists of a plate member having a staple pressing part 60*a*, at a lower end, which has a plate thickness corresponding to the line width of one staple 10 and a width corresponding to the outer size of the staple crown 10*a* of the staple 10. Also, the driver 60 is provided at an upper end with a shaft part 60*b* that is supported to the driver arm 61 and a driver pressing part 60*c* that is pressed by the driver arm 61.

The driver arm 61 has a pressing surface 61*a* that presses the driver pressing part 60*c* of the driver 60 and a driver guide recess 61*b* that supports the shaft part 60*b* of the driver 60 and guides the driver 60 rotatably and slidably.

In the driver arm 61, the pressing surface 61*a* is configured by a curved surface that is curved in a concave shape and the driver guide recess 61*b* is configured by a long hole that extends in the front-rear direction while conforming to the pressing surface 61*a* and is curved into a concave shape.

The magazine unit 5 and the driver unit 6 are attached to the upper handle attachment part 40 of the lower handle frame 4 at a state where the magazine guide 51 and the driver arm 61 are rotatable about the shaft 54*f* serving as a fulcrum. In this example, the magazine guide 51 and the driver arm 61 are rotated coaxially with the magazine stopper 54*a*.

In the driver unit 6, the driver 60 attached to the driver arm 61 is guided along the magazine front wall 50*a* of the magazine 50 by the spring guide 56 attached to the magazine guide 51.

While the magazine 50 does not contact the sheet and the driver arm 61 and the magazine guide 51 are integrally rotated about the shaft 54*f* serving as a fulcrum, a relative positional relation between the driver 60 and the magazine 50 is not changed.

When the sheets are held between the clincher unit 2A and the magazine 50 and the driver arm 61 is rotated relative to the magazine guide 51, the driver 60 is pressed by the driver arm 61 by the rotation operation of the driver arm 61 relative to the magazine guide 51.

Since the shaft part 60*b* of the driver 60 can move along the driver guide recess 61*b*, as the driver arm 61 is rotated, a position at which the pressing surface 61*a* of the driver arm 61 and the driver pressing part 60*c* of the driver 60 abut each other is changed. Thereby, an angle of the driver 60 pressing the staple 10 is kept at a predetermined angle.

At the standby state, an empty space 61*c* is formed between the driver arm 61 and the driver pressing part 58*c* of the link 58, so that the driver arm 61 does not contact the link 58. While the magazine 50 does not contact the sheet and the driver arm 61 and the magazine guide 51 are integrally rotated about the shaft 54*f* serving as a fulcrum, the empty space 61*c* between the driver arm 61 and the driver pressing part 58*c* of the link 58 is kept.

Then, when the sheets are held between the clincher unit 2A and the magazine 50 and the driver arm 61 is rotated relative to the magazine guide 51, the link 58 is pressed by the rotating operation of the driver arm 61 and the link 58 is rotated about the shaft 58*a* serving as a fulcrum, so that the slider 3 is operated.

<Example of Configuration of Handle Unit>

The handle unit 7 has a handle arm 70 that presses the driver arm 61, an upper handle cover 71 that covers the handle arm 70 and a front cover 72 that covers a gap formed between the upper handle cover 71 and the driver arm 61.

The handle arm 70 has a shaft hole 70*b* into which a shaft 70*a* attached to the upper handle attachment part 40 of the lower handle frame 4 is inserted, and is attached to the lower handle frame 4 via the shaft 70*a* and the shaft hole 70*b*. Also, the handle arm 70 is connected to the driver arm 61, which is supported to the upper handle attachment part 40 of the lower handle frame 4 by the shaft 54*f*, by a shaft 70*c*.

In the handle arm 70, the shaft hole 70*b* has a predetermined long hole shape. In this example, in the shaft hole 70*b*, a distance relative to the shaft 54*f* becoming a rotation fulcrum of the driver arm 61 is changed into a predetermined pattern depending on the rotation operations of the handle arm 70 and the driver arm 61.

The handle unit 7 and the driver unit 6 realize a boosting mechanism that reduces load to be applied to the handle arm 70 by a ratio of a distance between a point at which the force is applied to the handle arm 70 and the shaft hole 70*b* becoming the rotation fulcrum of the handle arm 70 and a distance between the shaft 70*c*, which is a point at which the force is applied to the driver arm 61, and the shaft hole 70*b* and a ratio of a distance between the shaft 70*c* and the shaft 54*f* becoming the rotation fulcrum of the driver arm 61 and a distance between a point at which the force is applied to the driver 60 and the shaft 54*f*.

By the shape of the shaft hole 70*b*, the load is heavy at the early stage of pressing the handle arm 70 and the heavy becomes light at a stage at which the staple 10 penetrates the sheets.

By providing the above boosting mechanism, a stroke of the handle arm 70 is extended and a gap is formed between the upper handle cover 71 attached to the handle arm 70 and the driver arm 61. Thus, as shown in FIG. 1, the front cover 72 covering the gap between the upper handle cover 71 and the driver arm 61 is attached.

Figure 30:
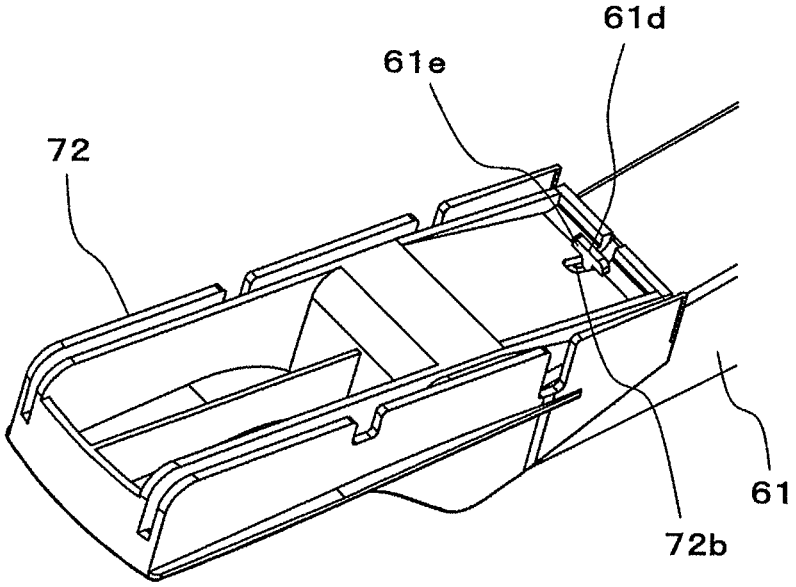
FIG. 30 is a perspective view showing an example of a front cover.

FIG. 30 is a perspective view showing an example of the front cover. The front cover 72 has a shape that covers the front and rear of the gap formed between the upper handle cover 71 and the driver arm 61. As shown in FIG. 1, the front cover 72 is attached to the handle arm 70 so that it can rotate about a shaft part 72*a* serving as a fulcrum, which is provided at one end portion of the front cover and is inserted into the shaft hole 70*d* provided to the handle arm 70.

Also, as shown in FIG. 30, the front cover 72 is attached to the driver arm 61 so that it can rotate and slide about a guide convex part 61*d* serving as a fulcrum, which is provided to the driver arm 61 and is inserted into a recess part 72*b* formed at the other portion of the front cover. In this example, the guide convex part 61*d* has a T-shape, as a deviation preventing shape, so that it is provided with a deviation preventing portion 61*e*. The guide convex part is inserted into the recess part 72*b* of the front cover 72 so that it can slide and rotate, and the separation of the recess part 72*b* is prevented.

In the meantime, the attachment structure of the front cover 72 and the driver arm 61 may be configured so that the front cover 72 is provided with the guide convex part having a deviation preventing shape and the driver arm 61 is provided with the recess part into which the guide convex part is inserted rotatably and slidably. Also, it may be possible that the front cover 72 and the driver arm 61 are rotatably connected by a shaft part and a shaft hole and the front cover 72 and the handle arm 70 are connected rotatably and slidably by a shaft hole having a long hole shape and a shaft part.

<Example of Operation of Stapler of This Exemplary Embodiment>

Figure 31A:
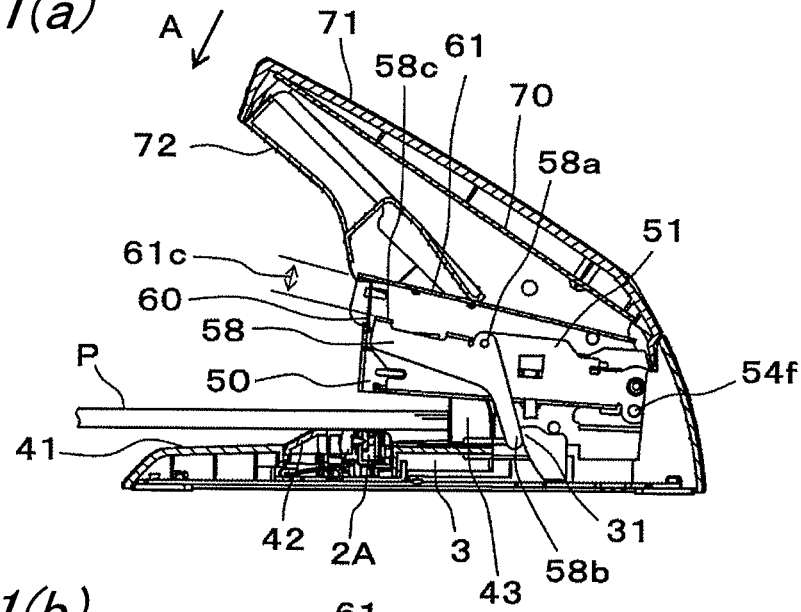
FIGS. 31(*a*) to 31(*c*) are side sectional views showing an operation of binding sheets by the stapler of the exemplary embodiment.
Figure 31B:
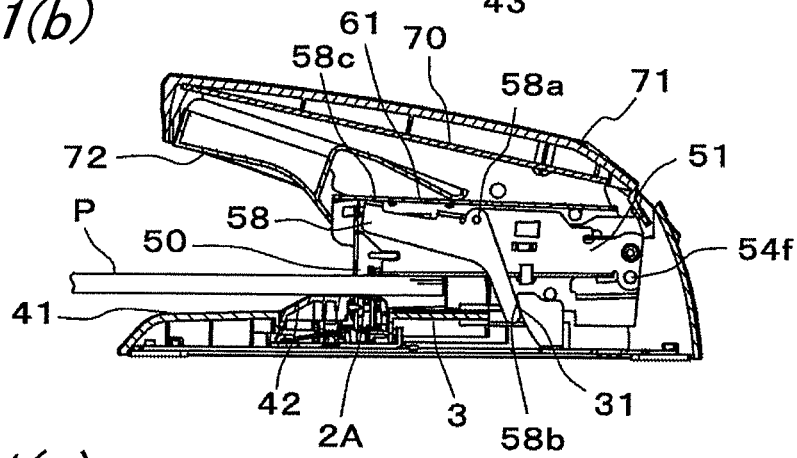
Figure 31C:
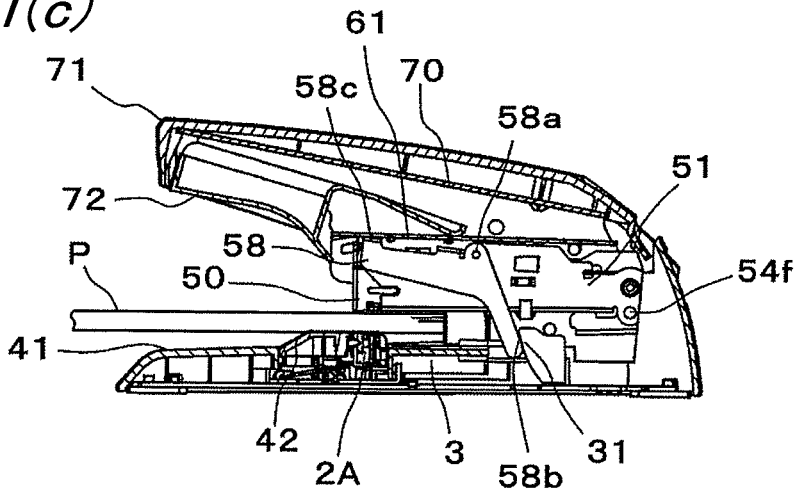
Figure 32A:
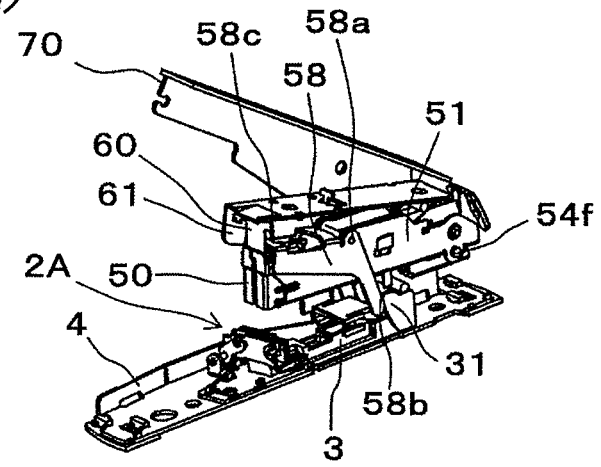
FIGS. 32(*a*) to 32(*c*) are perspective views showing an operation of binding sheets by the stapler of the exemplary embodiment.
Figure 32B:
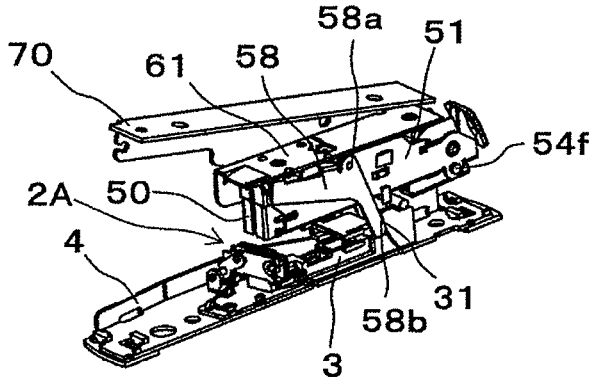
Figure 32C:
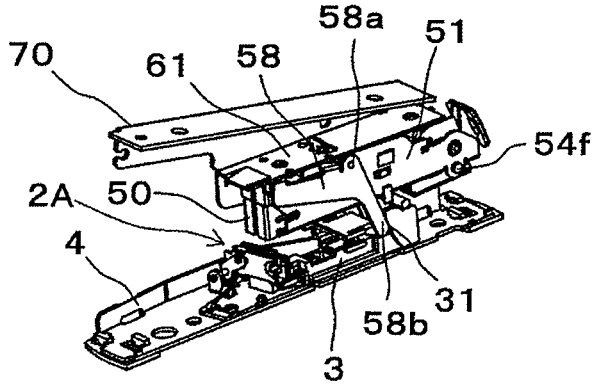

FIG. 31 is a side sectional view showing an operation of binding sheets by the stapler of the exemplary embodiment and FIG. 32 is a perspective view showing an operation of binding sheets by the stapler of the exemplary embodiment. In the below, an operation of binding the sheets by the stapler 1A of this exemplary embodiment is described with reference to the respective drawings.

First, at the standby state of the stapler 1A, as shown in FIG. 31 (*a*), the gap between the upper handle cover 71 and the driver arm 61 is covered by the front cover 72 attached to the upper handle cover 71 and the driver arm 61. Thereby, it is possible to prevent any object from being inserted into the gap between the upper handle cover 71 and the driver arm 61.

During the binding operation, the sheets P are put on the lower handle cover 41 and the clincher cover 42 of the lower handle unit 11*a*. In the stapler 1A, it is possible to adjust the binding positions of the staples 10 by adjusting the position of the sheet guide 43 and colliding the sheets P with the sheet guide 43.

When the sheets P are put on and the upper handle cover 71 is pressed in an arrow A direction from the standby state, the handle arm 70 covered by the upper handle cover 71 is rotated about the contact point of the shaft 70*a* and the shaft hole 70*b*, which is shown in FIG. 3 and the like and serves as a movement fulcrum. As the handle arm 70 is rotated, the driver arm 61 is pressed by the displacement of the shaft 70*c* and the driver arm 61 is rotated about the shaft 54*f* serving as a fulcrum.

The handle unit 7 and the driver unit 6 reduce the load to be applied to the handle arm 70 by a ratio of a distance between a point at which the force is applied to the handle arm 70 and the shaft hole 70*b* and a distance between the shaft 70*c* and the shaft hole 70*b* and a ratio of a distance between the shaft 70*c* and the shaft 54*f* and a distance between a point at which the force is applied to the driver 60 and the shaft 54*f*. By the shape of the shaft hole 70*b*, the load is heavy at the early stage of pressing the handle arm 70 and the heavy becomes light at a stage at which the staple 10 penetrates the sheets.

When the upper handle cover 71 is pressed, the gap between the upper handle cover 71 and the driver arm 61 is gradually narrowed. The front cover 72 is rotated relative to the handle arm 70 about the shaft part 72*a* serving as a fulcrum, as the upper handle cover 71, the handle arm 70 and the driver arm 61 are displaced.

In the meantime, as shown in FIG. 1, the driver arm 61 is rotated and slid about the guide convex part 61*d* serving as a fulcrum by the engaging of the recess part 72*b* and the guide convex part 61*d*. When the displacement is made in the direction of narrowing the gap between the upper handle cover 71 and the driver arm 61, a distance between the shaft part 72*a* of the handle arm 70 and the guide convex part 61*d* of the river arm 61 is shortened. Thereby, it is possible to enable the front cover 72 to follow the displacement of the gap between the upper handle cover 71 and the driver arm 61.

Also, the front cover 72 is engaged to the handle arm 70 by the shaft part 72*a*, so that it is not easily separated. Also, regarding the driver arm 61, the front cover is freely moved by the engaging of the recess part 72*b* and the guide convex part 61*d* with respect to the displacement of the gap between the upper handle cover 71 and the driver arm 61 but is not easily separated. Thereby, it is prevented that only the front cover 72 is moved and thus any object is inserted into the gap between the upper handle cover 71 and the driver arm 61.

Figure 33:
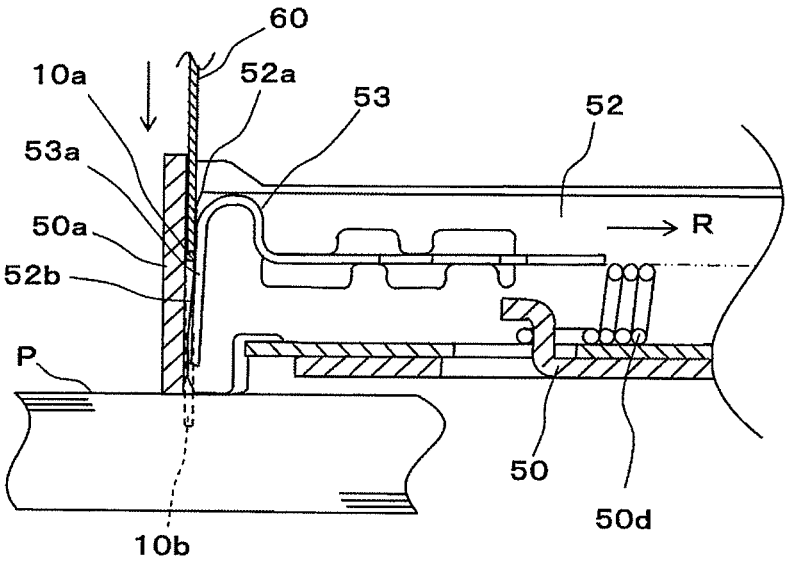
FIG. 33 illustrates an example of an operation of discharging the staple in the stapler of the exemplary embodiment.

FIG. 33 illustrates an example of an operation of discharging the staple in the stapler of the exemplary embodiment. In the below, the operations of the magazine unit 5 and the driver unit 6, which are performed when discharging the staple 10, are described with reference to the respective drawings.

At the early stage of pressing the handle arm 70 from the standby state, the magazine 50 does not contact the ,sheet P and the driver arm 61 and the magazine guide 51 are integrally rotated about the shaft 54*f* serving as a fulcrum.

When the sheets Pare held between the clincher unit 2A and the magazine 50, the rotation of the magazine guide 51 is restrained and the handle arm 70 is further pressed, so that the driver arm 61 is rotated relative to the magazine guide 51.

When the driver arm 61 is rotated relative to the magazine guide 51, the driver 60 is pressed by the driver arm 61. In the configuration where the staple 10 having the long legs 10*b* as shown in FIG. 11(*a*) can be used, it is necessary to extend the stroke of the driver. Thus, in the configuration where the driver is fixed to the driver arm, as the driver arm 61 is rotated, the change in the angle of the driver relative to the magazine front wall 50*a* of the magazine 50 is increased.

To the contrary, the driver 60 is kept at a predetermined angle so that as the driver arm 61 is rotated, a position at which the pressing surface 61*a* of the driver arm 61 and the driver pressing part 60*c* of the driver 60 abut each other is changed and an angle of the driver 60 pressing the staple 10 conforms to the magazine front wall 50*a* of the magazine 50.

When the staples 10 loaded in the magazine 50 are pressed by the driver 60, the one head staple of the staples 10 is positioned on the gap formed by the shear guide parts 52*a* shown in FIG. 23 and the second staple and thereafter of the staples are supported on the upper surface of the staple guide 52. Thus, the first staple 10 is applied with the shear force and is thus separated.

The staple 10 that is pressed by the driver 60 is introduced from the gap between the magazine front wall 50*a* and the shear guide parts 52*a* to the gap between the magazine front wall 50*a* and the pressing guide parts 52*b*.

As described above, in the magazine 50, the staple guide 52 is pressed forward by the coil spring 50*d* and the magazine lock spring 54*c*, and the width guide part 52*c* of the staple guide 52 abuts on the magazine front wall 50*a* except for the process of discharging the staple 10.

The pressing guide parts 52*b* are configured so that the gap t2 between the magazine front wall 50*a* and the pressing guide part is slightly narrower than the line width of the one staple 10 at the state where the width guide parts 52*c* abut on the magazine front wall 50*a*.

Thereby, the staple 10 pressed by the driver 60 presses the pressing guide parts 52*b* at both ends of the staple crown 10*a* and thus elastically deforms the coil spring 50*d* in an extending direction and elastically deforms the magazine coil spring 54*c* in a compressing direction, thereby retreating the staple guide 52 in an arrow R direction.

By retreating the staple guide 52, the staple 10 between the pressing guide parts 52*b* and the magazine front wall 50*a* is pressed toward the magazine front wall 50*a* as both ends of the staple crown 10*a* is pressed with the pressing guide parts 52*b*.

In order to separate and discharge one staple by the pressing of the driver, it is necessary to form a gap wider than the line width of one staple between the leading end of the staple guide and the magazine front wall. In a zone in which a gap between the leading end of the staple guide and the magazine front wall is wider than the line width of one staple, the staple crown of the staple may move forward and rearward.

Hence, a posture of the staple may be changed before the leading ends of the legs of the staple land on and penetrate the sheets. Also, for a staple having long legs, even after the leading ends of the legs of the staple land on and penetrate the sheets, there is a possibility that there is a staple crown in a zone in which a gap between the leading end of the staple guide and the magazine front wall is wider than the line width of one staple and a posture of the staple will be thus changed.

In this exemplary embodiment, the leading end of the staple guide 52 is provided with the shear guide parts 52*a* and the pressing guide parts 52*b*. Hence, it is possible to separate one staple 10 by the shear guide parts 52*a* and to guide the staple crown 10*a* of the one separated staple 10 by the pressing guide parts 52*b*.

Regarding the staple 10 passing between the pressing guide parts 52*b* and the magazine front wall 50*a*, since both ends of the staple crown 10*a* are pressed to the magazine front wall 50*a* by the pressing guide parts 52*b*, a gap is not caused in which the staple crown 10*a* of the staple 10 can move forward and rearward.

Also, as described above, the shape of the shear guide parts 52*a* is set so that even when the staple 10 having long legs 10*b* as shown in FIG. 11(*a*) is used, the staple crown 10*a* is guided by the pressing guide parts 52*b* before the leading ends of the legs 10*b* reach the sheet.

Thereby, it is possible to prevent a posture of the staple 10 from being changed before the leading ends of the legs 10*b* of the staple 10 land on and penetrate the sheets. Also, even for the staple 10 having long legs 10*b*, before the leading ends of the legs 10*b* of the staple 10 land on and penetrate the sheets P, the staple crown 10*a* gets out of the shear guide parts 52*a* and is guided by the pressing guide parts 52*b*. Hence, it is possible to prevent a posture of the staple 10 from being changed during the penetration of the legs 10*b*.

Regarding the staple 10 in the zone in which the staple crown 10*a* is guided by the pressing guide parts 52*b*, since the interval of two legs 10*b* is guided by the width guide parts 52*c*, it is possible to set the left and right guides as the width guide parts 52*c*.

When the staple crown 10*a* passes through the pressing guide parts 52*b*, the staple guide 52 is further retreated, so that the staple 10 pressed by the driver 60 enters the gap formed between the width guide parts 52*c* and the magazine front wall 50*a*. Regarding the staple 10 in a zone where the staple crown 10*a* is guided between the width guide parts 52*c* and the magazine front wall 50*a*, since the legs 10*b* penetrate the sheets P, it is possible to prevent a posture of the staple from being changed even without the guide in the width direction by the width guide parts 52*c*.

Regarding the staple 10 in a zone where the staple crown 10*a* is guided by the pressing guide parts 52*b* and the staple 10 in a zone where the staple crown 10*a* is guided between the width guide parts 52*c* and the magazine front wall 50*a*, the force of pushing up the staple crown 10*a* is applied by the staple crown guide part 53*a* of the staple holder 53. Thereby, it is possible to prevent the central part of the staple crown 10 from being bent downward due to the pressing of the driver 60.

Figure 34A:
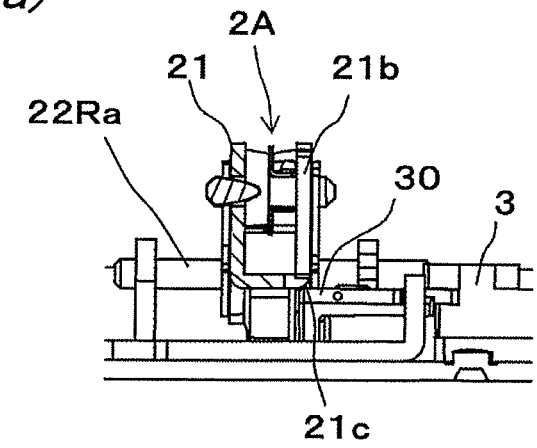
FIGS. 34 (*a*) to 34 (*c*) are side views of main parts showing an example of an operation of a slider.
Figure 34B:
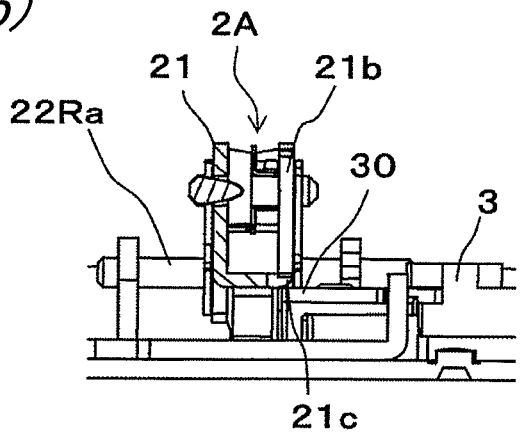
Figure 34C:
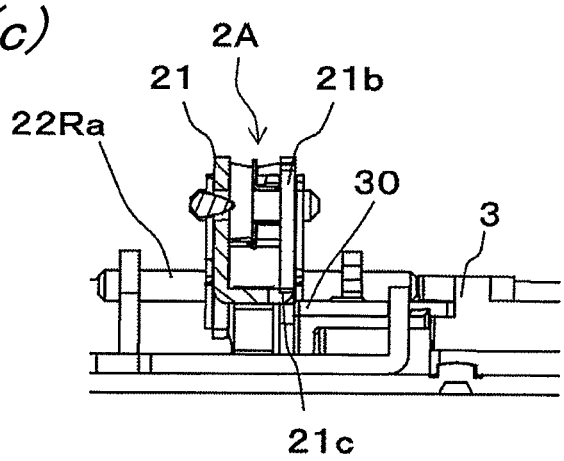

FIG. 34 is a side view of main parts showing an example of an operation of the slider. In the below, an operation of transmitting the movement of the link 58 to the slide 3 in the upper handle unit lib is described with reference to the respective drawings.

At the standby state, as shown in FIG. 34 (*a*), the slider 3 is advanced to the clincher lock position and the rear holder 21*b* of the clincher holder 21 configuring the clincher unit 2A is put on the engaging part 30. Thereby, the descent of the clincher holder 21 is restrained.

As shown in FIGS. 31(*a*) and 32(*a*), at the standby state, the empty space 61*c* is formed between the driver arm 61 and the driver pressing part 58*c* of the link 58, so that the driver arm 61 does not contact the link 58.

While the magazine 50 does not contact the sheet P and the driver arm 61 and the magazine guide 51 are integrally rotated about the shaft 54*f*, the empty space 61*c* between the driver arm 61 and the driver pressing part 58*c* of the link 58 is kept. In the meantime, the driver arm 61 and the magazine guide 51 are integrally rotated about the shaft 54*f* serving as a fulcrum, so that the link 58 is displaced relative to the link bearing part 31 of the slider 3.

The slider 3 and the link 58 are configured so that the link bearing part 31 and the slider pressing part 58*b* abut from the standby state. Thus, the slider 3 and the link 58 are set so that the shapes of the link bearing part 31 and the slider pressing part 58*b* do not permit the movement of the slider 3 by the displacement of the link 58 accompanied by the rotation of the magazine guide 51 about the shaft 54*f* serving as a fulcrum.

When the sheets P are held between the clincher unit 2A and the magazine 50 and the driver arm 61 is rotated relative to the magazine guide 51, the one separated staple 10 is discharged by the driver 60 and the legs 10*b* of the staple 10 penetrate the sheets P, as described above.

When the driver arm 61 is rotated relative to the magazine guide 51, the empty space 61*c* between the driver arm 61 and the link 58 is gradually narrowed. After the leading ends of the legs 10*b* of the staple 10 get out of the backside of the sheet P, the driver arm 61 and the driver pressing part 58*c* of the link 58 abut, as shown in FIGS. 31(*b*) and 32(*b*).

At a stage where the driver arm 61 and the driver pressing part 58*c* of the link 58 start to contact each other, as shown in FIG. 34(*b*), the slider 3 is not moved yet and the rear holder 21*b* of the clincher holder 21 is put on the engaging part 30, so that the descent of the clincher holder 21 is restrained.

When the handle arm 70 is further pressed and thus the driver arm 61 is further rotated relative to the magazine guide 51, the link 58 is pressed by the rotation operation of the driver arm 61, so that the link 58 is rotated about the shaft 58*a* serving as a fulcrum, as shown in FIG. 32(*c*).

When the link 58 is rotated, the link bearing part 31 of the slider 3 is pressed by the slider pressing part 58*b*. Thereby, as shown in FIG. 34(*c*), the slider 3 is retreated and the engaging part 30 is separated from the rear holder 21*b* of the clincher holder 21, so that the clincher holder 21 can descend.

In the conventional stapler having a flat clinch mechanism and a boosting mechanism, the leading end of the link is shaft-supported to the driver arm, the sheets are held between the clincher and the magazine and the link also starts to rotate at timing at which the driver arm starts to rotate relative to the magazine.

In the meantime, in order that the penetrating load applied when the staple penetrates the sheets and the load of pulling the slider do not overlap each other, it is necessary for the slider to operate after the leading ends of the legs of the staple penetrate the sheets. Hence, according to the conventional stapler, the empty space is provided between the slider pressing part of the link and the slider. However, in the configuration where the staples having long legs are used, since it is necessary to extend the stroke of the driver arm and to increase an operation amount of the link, the empty space between the link and the slider is extended.

In order to increase the operation amount of the link, it is necessary to provide the slider pressing part at the front. As a result, it is not possible to increase an insertion amount in a depth direction at the binding position of the sheets. Also, since the operation amount of the link is increased, the apparatus is enlarged.

However, in this exemplary embodiment, the link 58 is shaft-supported to the magazine guide 51 and the empty space 61*c* is formed between the driver pressing part 58*c* of the link 58 and the driver arm 61. Also, the link 58 is configured in a weight distribution manner that the slider pressing part 58*b* is rotated by its own weight in a direction of abutting on the link bearing part 31 of the slider 3 and thus the slider pressing part 58*b* of the link 58 is enabled to contact the link bearing part 31 of the slider 3 from the standby position.

The empty space 61*c* is formed between the link 58 and the driver arm 61, so that the sheets P are held between the clincher unit 2A and the magazine 50 and the link 58 does not rotate at the timing at which the driver arm 61 starts to rotate relative to the magazine guide 51. Then, the link 58 starts to rotate after the leading ends of the legs 10*b* of the staple 10 penetrate the sheets P.

Thereby, even for the configuration where the staples 10 having long legs 10*b* can be used, it is possible to decrease the operation amount of the link 58. Even at the standby state shown in FIGS. 4, 31(*a*), 32(*a*) and the like, it is possible to keep the state where the slider pressing part 58*b* and the link bearing part 31 always contact each other. Also, it is possible to position the slider pressing part 58*b* at the rear of the front end of the upper handle attachment part 40 of the lower handle frame 4.

At the standby state, the slider pressing part 58*b* of the link 58 is positioned at the rear of the front end of the upper handle attachment part 40 of the lower handle frame 4. Thereby, it is possible to locate the movement position of the sheet guide 43 up to the front end of the upper handle attachment part 40.

Accordingly, as shown in FIG. 31(*a*), when the sheet guide 43 is positioned at the front end of the upper handle attachment part 40, it is possible to prolong a distance from the end portion of the sheet P to the binding position of the staple 10. Also, when the sheet guide 43 is positioned close to the clincher unit 2A, it is possible to shorten a distance from the end portion of the sheet P to the binding position of the staple 10.

Figure 35A:
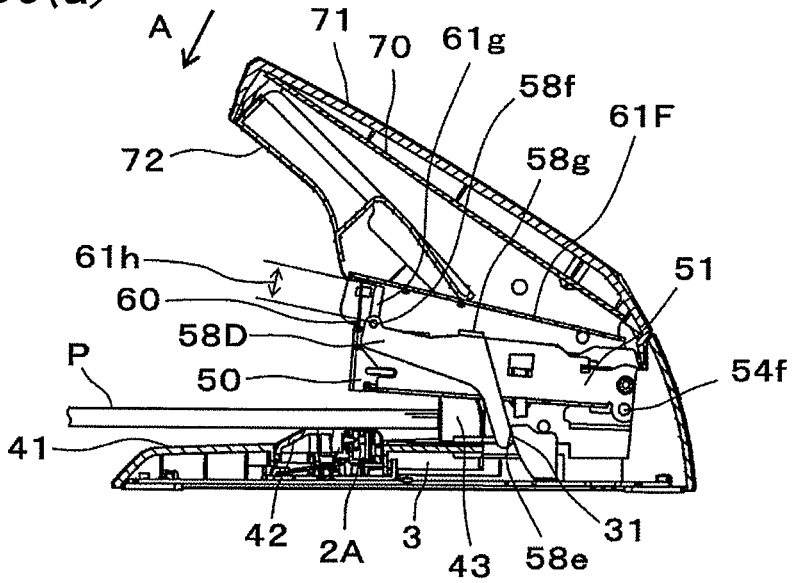
FIGS. 35(*a*) to 35(*c*) are side sectional views showing an operation of binding sheets by a stapler of a modified embodiment.
Figure 35B:
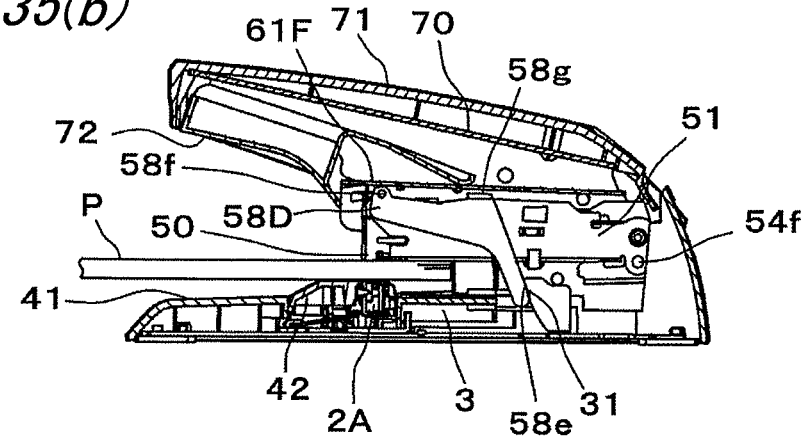
Figure 35C:
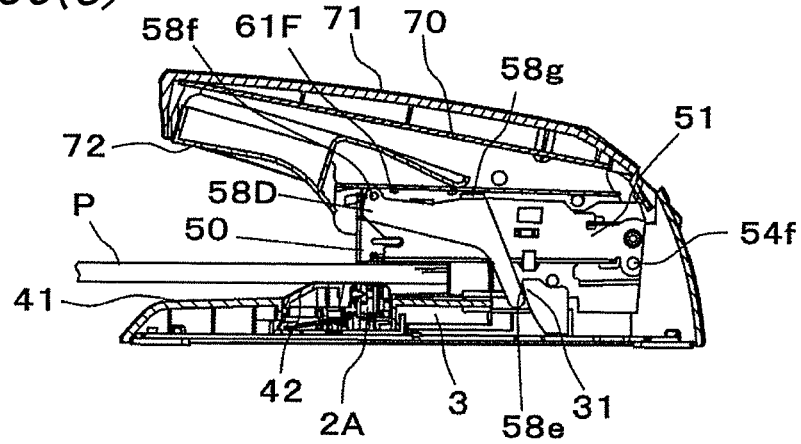

FIG. 35 is a side sectional view showing an operation of binding the sheets by a stapler of a modified embodiment. In this modified embodiment, a link 58D is configured so that a slider pressing part 58*e* formed at one end portion of a substantial L shape abuts on the link bearing part 31 of the slider 3. Also, the link 58D is configured so that a leading end, which is the other end portion, is shaft-supported to a driver arm 61F. The driver arm 61F is formed with a long hole 61*g* into which a shaft 58*f* of the link 58D is slidably inserted, so that an empty space 61*h* is formed.

Also, the link 58D has a sliding support part 58*g* to be put on the magazine guide 51 at an apex part of a substantial L shape between the slider pressing part 58*e* and the shaft 58*f*, and is slidably supported on the upper surface of the magazine guide 51.

The link 58D is configured in a weight distribution manner that the slider pressing part 58*e* is rotated by its own weight in a direction of abutting on the link bearing part 31 of the slider 3, and thus the slider pressing part 58*e* and the link bearing part 31 always contact each other.

Also, the shaft 58*f* is positioned at the lower end side of the long hole 61*g*, so that the empty space 61*h* is formed.

Describing the operations of the modified embodiment, as shown in FIG. 35(*a*), the link 58D and the driver arm 61F are configured so that the shaft 58*f* of the link 58D is positioned at the lower end side of the long hole 61*g* of the driver arm 61F and the empty space 61*h* is thus formed.

While the magazine 50 does not contact the sheet and the driver arm 61F and the magazine guide 51 are integrally rotated about the shaft 54*f* serving as a fulcrum, the empty space 6*h* between the long hole 61*g* of the driver arm 61F and the shaft 58*f* of the link 58D is kept. In the meantime, the driver arm 61F and the magazine guide 51 are integrally rotated about the shaft 54*f* serving as a fulcrum, so that the link 58D is displaced relative to the link bearing part 31 of the slider 3.

The slider 3 and the link 58D are configured so that the link bearing part 31 and the slider pressing part 58*e* abut from the standby state. Thus, the slider 3 and the link 58D are set so that the shapes of the link bearing part 31 and the slider pressing part 58*e* do not permit the movement of the slider 3 by the displacement of the link 58D accompanied by the rotation of the magazine guide 51 about the shaft 54*f* serving as a fulcrum.

When the sheets P are held between the clincher unit 2A and the magazine 50 and the driver arm 61F is rotated relative to the magazine guide 51, the one separated staple 10 is discharged by the driver 60 and the legs 10*b* of the staple 10 penetrate the sheets P, as described above.

When the driver arm 61F is rotated relative to the magazine guide 51, the long hole 61*g* of the driver arm 61F is displaced relative to the shaft 58*f* of the link 58D, so that the empty space 61*c* is gradually narrowed. After the leading ends of the legs 10*b* of the staple 10 get out of the backside of the sheet P, the shaft 58*f* of the link 58D abuts on the upper end of the long hole 61*g* of the driver arm 61*f*, as shown in FIG. 35(*b*).

At a stage where the shaft 58*f* of the link 58D starts to contact the upper end of the long hole 61*g* of the driver arm 61*f*, the slider 3 is not moved yet and the rear holder 21*b* of the clincher holder 21 is put on the engaging part 30, so that the descent of the clincher holder 21 is restrained.

When the handle arm 70 is further pressed and thus the driver arm 61F is further rotated relative to the magazine guide 51, the long hole 61*g* presses the shaft 58*f* by the rotation operation of the driver arm 61, so that the link 58D is pressed. Thus, as shown in FIG. 35(*c*), the link 58D is rotated about the contact point of the sliding support part 58*g* and the magazine guide 51 serving as a movement fulcrum.

When the link 58D is rotated, the link bearing part 31 of the slider 3 is pressed by the slider pressing part 58*e*. Thereby, the slider 3 is retreated and the engaging part 30 is separated from the rear holder 21*b* of the clincher holder 21, so that the clincher holder 21 can descend.

Also in the modified embodiment, the empty space 61*h* is formed by the shaft 58*f* of the link 58D and the long hole 61*g* of the driver arm 61F, so that it is possible to decrease the operation amount of the link 58D.

Meanwhile, in an alternative modified embodiment, the link is shaft-supported to the driver arm and the driver arm is formed with the long hole into which the shaft of the link is slidably inserted, so that the link is moveably guided along a moving direction of the driver arm. Also, the link is configured so that the slider pressing part formed at one end portion of a substantial L shape abuts on the slider and the driver pressing part formed at the other end portion is pressed by the driver arm. The empty space may be formed between the driver pressing part and the driver arm. Also, the shape of the link is not limited to the L shape. That is, any shape is possible insomuch as a contact part with the slider can be formed at one end side and a contact part with the driver arm can be formed at the other end side.

Figure 36A:
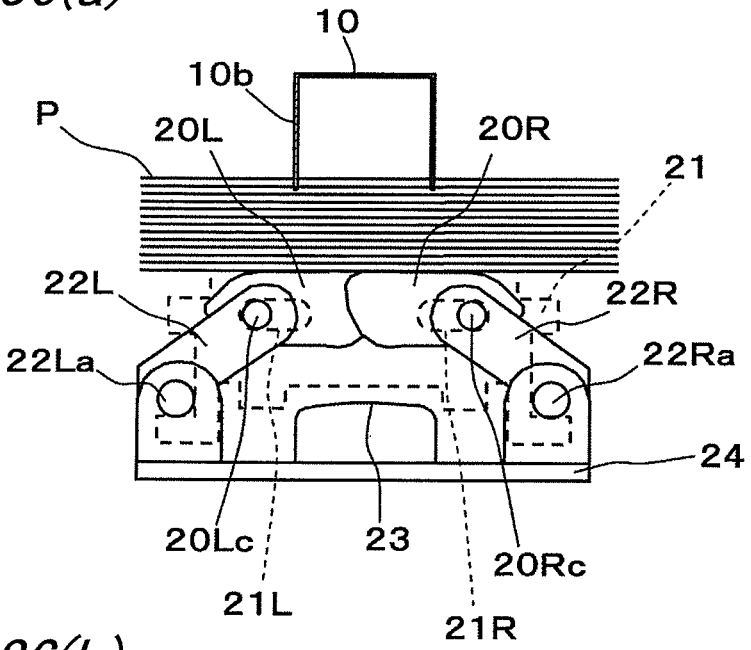
FIGS. 36(*a*) and 36(*b*) illustrate an example of an operation of the clincher unit.
Figure 36B:
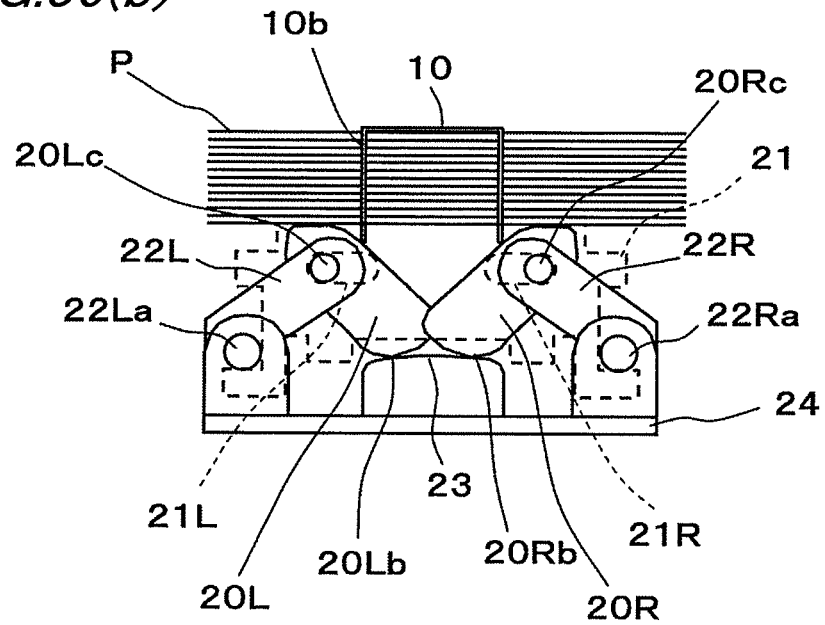
Figure 37A:
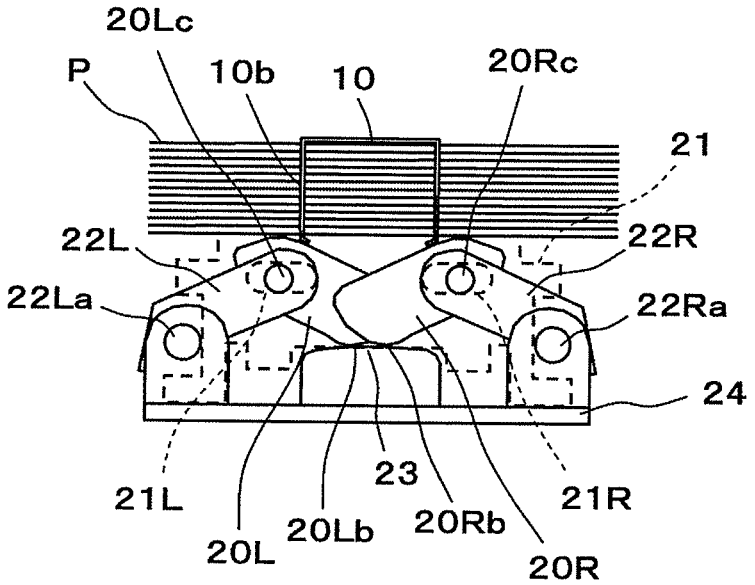
FIGS. 37(*a*) and 37(*b*) illustrate an example of an operation of the clincher unit.
Figure 37B:
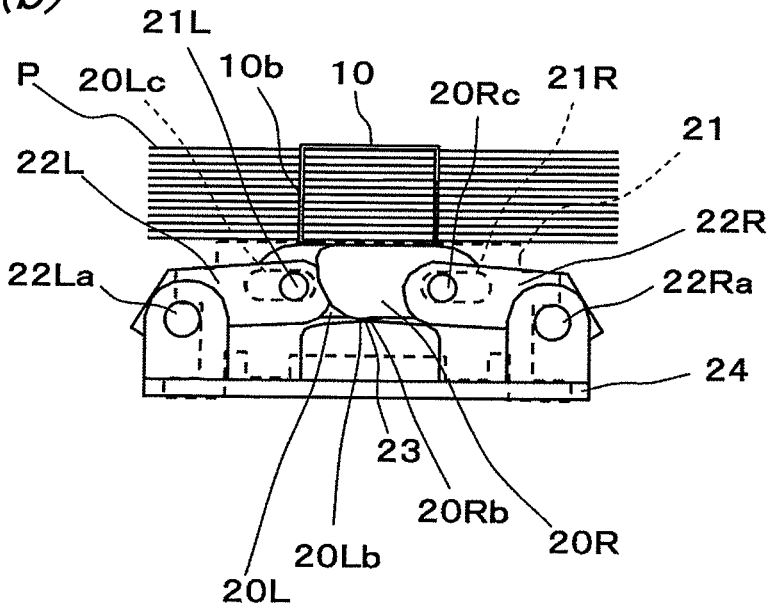
Figure 38A:
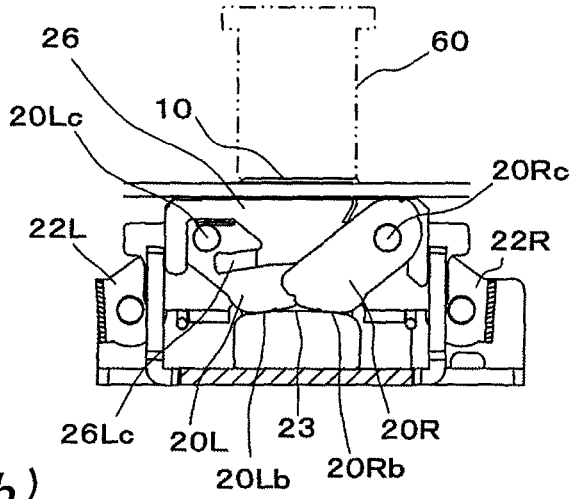
FIGS. 38(*a*) to 38(*c*) illustrate an example of an operation of the clincher unit.
Figure 38B:
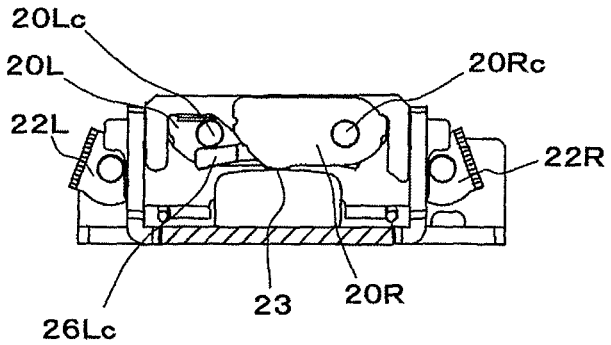
Figure 38C:
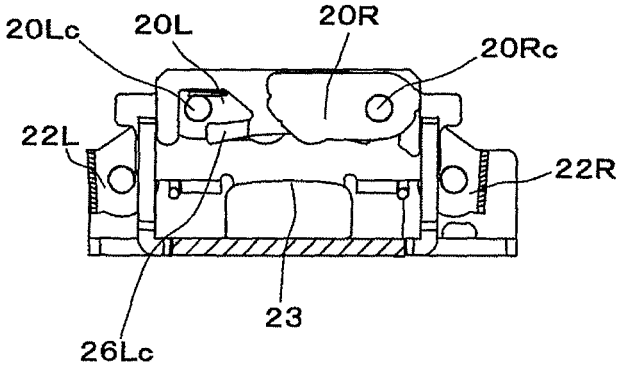

FIGS. 36 to 38 illustrate examples of the operation of the clincher unit. In the below, operations of a flat clinch mechanism are described with reference to the respective drawings.

When the sheets P are put on a predetermined position and the upper handle cover 71 is pressed, the one separated staple 10 is discharged by the driver 60, as described above, and the legs 10*b* of the staple 10 are inserted into and start to penetrate the sheets P, as shown in FIG. 36(*a*). At a stage where the legs 10*b* of the staple 10 start to penetrate the sheets P, the slider 3 is not moved yet and the rear holder 21*b* of the clincher holder 21 is put on the engaging part 30, so that the descent of the clincher holder 21 is restrained, as described in FIG. 34(*a*).

When the staple 10 is further discharged by the driver 60 and the leading ends of the legs 10*b* penetrate the sheets P and protrude from the backside of the sheet P, one leg 10*b* presses the clincher 20L and the other leg 10*b* presses the clincher 20R. At a stage where the leading ends of the legs 10*b* start to protrude from the backside of the sheet P, as shown in FIG. 34(*b*), the slide 3 is not moved yet and the rear holder 21*b* of the clincher holder 21 is put on the engaging part 30, so that the descent of the clincher holder 21 is restrained.

The side face of the clincher 20L is pressed by the spring part 26Lc of the partition plate 26 and the side face of the clincher 20R is pressed by the spring part 26Rc of the partition plate 26, so that the directions are kept. At this time, the pressing force of the staple 10 by the pressing of the driver 60 is higher than the pressing force by the spring part of the partition plate 26.

Thereby, as shown in FIGS. 36(*b*) and 38(*a*), the clincher surface 20La is pressed by the one leg 10*b* of the staple 10, so that the clincher 20L is rotated downward about the shaft 20Lc serving as a fulcrum. Also, the clincher surface 20Ra is pressed by the other leg 10*b* of the staple 10, so that the clincher 20R is rotated downward about the shaft 20Rc serving as a fulcrum.

When the staple 10 is further discharged by the driver 60 and the leading ends of the legs 10*b* penetrate the sheets P, the slider 3 is retreated by the above-descried operation of the link 58, as shown in FIG. 34 (*c*), and the engaging part 30 is separated from the rear holder 21*b* of the clincher holder 21, so that the clincher holder 21 can descend.

Thereby, as shown in FIG. 37(*a*), the clincher holder 21 descends by the force that is generated as the upper handle cover 71 is pressed and thus the magazine 50 presses the clincher holder 21 via the sheets P. By the descent operation of the clincher holder 21, the clincher link 22L is rotated about the shaft 22La serving as a fulcrum in a direction along which the upper end of the clincher link comes close to the clincher link 22R. Also, by the descent operation of the clincher holder 21, the clincher link 22R is rotated about the shaft 22Ra serving as a fulcrum in a direction along which the upper end of the clincher link comes close to the clincher link 22L.

Like this, by the descent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is narrowed. Therefore, by the descent operation of the clincher holder 21, the clincher 20L and the clincher 20R are horizontally moved in the approaching direction.

Also, by the descent operation of the clincher holder 21, the pressing surface 20Lb of the clincher 20L is pressed by the clincher support part 23 and the pressing surface 20Rb of the clincher 20R is pressed by the clincher support part 23.

Thereby, the pressing surface 20Lb is pushed up by the clincher support part 23, so that the clincher 20L is rotated upward about the shaft 20Lc serving as a fulcrum. Also, the pressing surface 20Rb is pushed up by the clincher support part 23, so that the clincher 20R is rotated upward about the shaft 20Rc serving as a fulcrum.

Therefore, the one leg 10*b* of the staple 10 abutting on the clincher surface 20La of the clincher 20L and the other leg 10*b* of the staple 10 abutting on the clincher surface 20Ra of the clincher 20R are respectively applied with the bending force that is generated as the clincher 20L and the clincher 20R are moved in the approaching direction each other. The clincher 20L and the clincher 20R are rotated upward, so that they are bent inward.

When the clincher holder 21 descends to the lowest end position by the force that is generated as the upper handle cover 71 is pressed and thus the magazine 50 presses the clincher holder 21 via the sheets P, the clincher 20L and the clincher 20R pushed up by the clincher support part 23 are returned to the substantially horizontal positions, as shown in FIG. 37(*b*). Thereby, the legs 10*b* having penetrated the sheets P are bent along the surface of the sheet P, so that the clinch operation is completed.

In the configuration of bending the legs of the staple by the rotation operation of the pair of left and right clinchers, when there are many sheets to be bound and the protrusion amount of the legs from the backside of the sheet is small, the legs collide with the clincher surfaces at the upper sides of the rotation fulcrum of the clinchers. At this state, when the clinchers rotate, as a movement of starting to bend the legs, the force of pushing up the legs outward is applied.

However, in this exemplary embodiment, the clincher 20L and the clincher 20R are moved in the approaching direction each other, as a movement of starting to bend the legs, so that it is possible to apply the force of bending the legs 10*b* inward. Thereby, even when the legs collide with the clincher surfaces 20La, 20Lb at the upper sides of the rotation fulcrum of the clinchers 20L, 20R, it is possible to securely perform the clinch operation by applying the force of bending the legs 10*b* inward.

After completing the clinch operation, when the force of pressing the upper handle cover 71 is released, the upper handle unit 11*b* is pushed up by a return spring (not shown). When the force of pressing the clincher holder 21 is released, the clincher holder 21 is pushed up by the return spring 25.

By the ascent operation of the clincher holder 21, the clincher link 22L is rotated about the shaft 22La serving as a fulcrum so that the upper end side thereof becomes more distant from the clincher link 22R. Also, by the ascent operation of the clincher holder 21, the clincher link 22R is rotated about the shaft 22Ra serving as a fulcrum so that the upper end side thereof becomes more distant from the clincher link 22L.

Like this, by the ascent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is widened.

The clincher 20L, which is pushed up by the clincher support part 23 and is thus returned to the substantial horizontal position, is pressed at the side face thereof by the spring part 26Lc of the partition plate 26, and the clincher 20R is pressed at the side face thereof by the spring part 26Rc of the partition plate 26.

Thereby, while the clincher 20L and the clincher 20R returned to the substantial horizontal positions keep the substantial horizontal positions without rotating downward by the own weights, the clincher 20L and the clincher 20R are moved in the getting away direction each other by the ascent operation of the clincher holder 21, as shown in FIGS. 38(*b*) and 38(*c*). Then, the clincher unit 2A is returned to the standby position.

In the configuration of bending the legs of the staple by the rotation operation of the pair of left and right clinchers, the clinchers are not applied with the urging force in the rotating direction, are rotated downward by the pressing of the legs and are returned by the pushing-up of the clincher support part. Therefore, at the state where the clincher unit is at the standby position, the clinchers may be rotated downward.

At this state, a space is formed at the inside of the clincher holder, so that the foreign matters are introduced therein. Also, the outward appearance may be deteriorated.

However, in this exemplary embodiment, it is possible to maintain the directions of the clinchers 20L, 20R by the spring parts 26Lc, 26Rc provided to the partition plate 26. Hence, it is possible to keep the directions of the clinchers 20L, 20R at the substantially horizontal positions until the clinchers are pressed by the legs 10*b* of the staple 10.

Thereby, as shown in FIG. 18, for example, at the standby state, the opening of the clincher cover 42 is blocked by the clinchers 20L, 20R, so that it is possible to remove the cause of the introduction of the foreign matters. Also, it is possible to improve the outward appearance.

Figure 39:
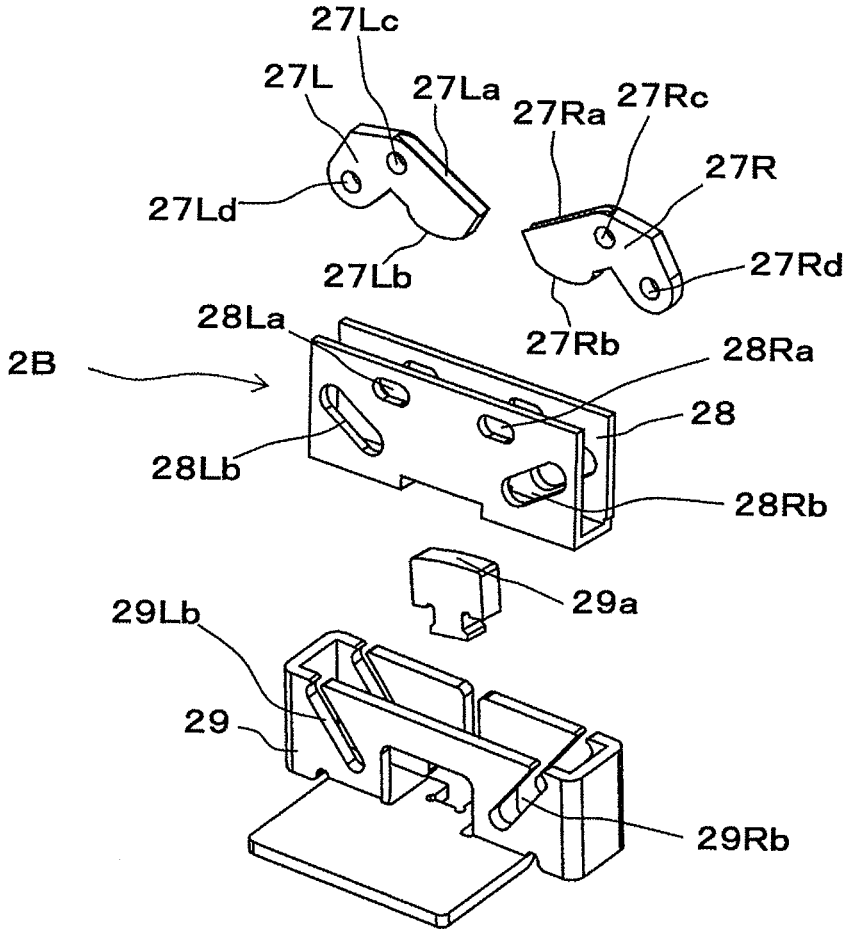
FIG. 39 is an exploded perspective view showing a modified embodiment of the clincher unit.
Figure 40A:
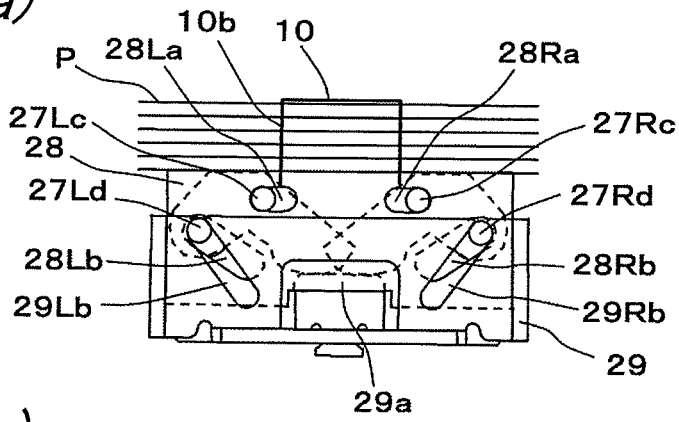
FIGS. 40(*a*) to 40(*c*) illustrate an example of an operation of the clincher unit of the modified embodiment.
Figure 40B:
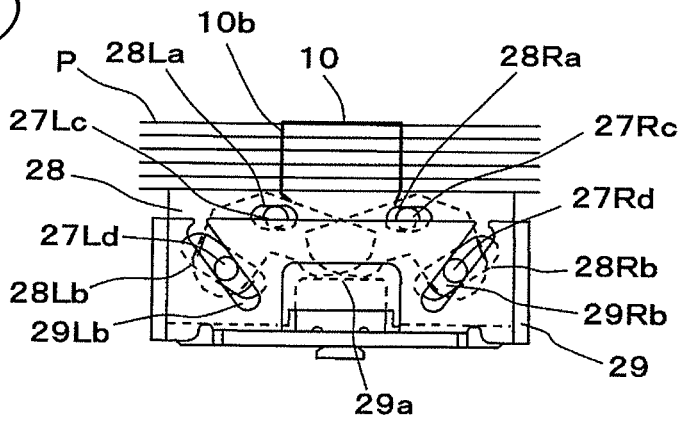
Figure 40C:
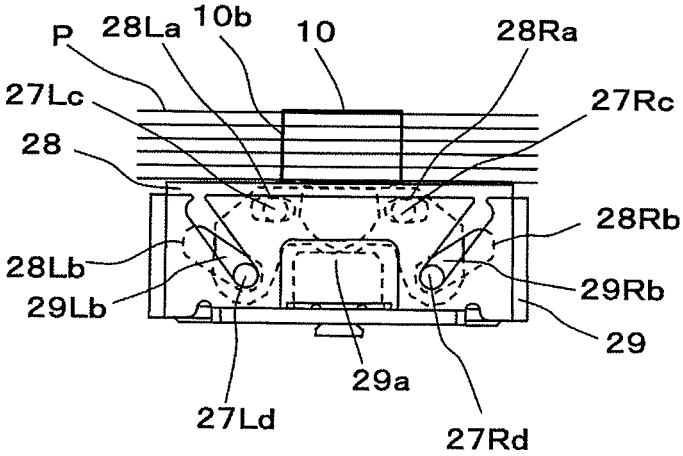

FIG. 39 is an exploded perspective view showing a modified embodiment of the clincher unit and FIG. 40 illustrates an example of an operation of the clincher unit of the modified embodiment. A clincher unit 2B of the modified embodiment is a clincher driving mechanism and rotates and moves the clinchers in the separating/contacting directions by guide through recesses.

The clincher unit 2B has a pair of clinchers 27L, 27R that bends the legs 10*b* of the staple 10 having penetrated the sheets and a clincher holder 28 that supports the clincher 27L and the clincher 27R.

Also, the clincher unit 2B has a holder guide 29 that guides the movement of the clincher holder 29 in the ascent and descent direction and guides the rotation of the clinchers 27L, 27R and the movement thereof in the separating/contacting directions. Further, the clincher unit 2B has a clincher support part 29*a* that pushes up the clinchers 27L, 27R by the ascent and descent operation of the clincher holder 28.

The clincher unit 2B is arranged so that positions of the clincher 27L and the clincher 27R are deviated in the left-right direction along the staple crown 10*a* of the staple 10 and in the front-rear direction orthogonal to the staple crown 10*a*.

The clincher 27L is disposed to face one leg 10*b* of the staple 10 and is formed on an upper surface facing the leg 10*b* with a clincher surface 27La that is inclined in a downward direction toward the clincher 27R arranged to be offset in the front-rear direction. Also, the clincher 27L is formed with a pressing surface 27Lb, which is pressed by the clincher support part 29*a*, on a lower surface of one end portion facing the clincher support part 29*a*.

The clincher 27L is supported in a guide hole 28La of the clincher holder 28 by a shaft 27Lc so that it can be rotated and horizontally moved.

Also, the clincher 27L is configured so that the other end portion is moveably supported along a guide hole 28Lb of the clincher holder 28 and a guide hole 29Lb of the holder guide 29 by a shaft 27Ld.

The clincher 27R is disposed to face the other leg 10*b* of the staple 10 and is formed on an upper surface facing the leg 10*b* with a clincher surface 27Ra that is inclined in a downward direction toward the clincher 27L arranged to be offset in the front-rear direction. Also, the clincher 27R is formed with a pressing surface 27Rb, which is pressed by the clincher support part 29*a*, on a lower surface of one end portion facing the clincher support part 29*a*.

The clincher 27R is supported in a guide hole 28Ra of the clincher holder 28 by a shaft 27Rc so that it can be rotated and horizontally moved. Also, the clincher 27R is configured so that the other end portion is moveably supported along a guide hole 28Rb of the clincher holder 28 and a guide hole 29Rb of the holder guide 29 by a shaft 27Rd.

In the clincher holder 28, the guide hole 28La and the guide hole 28Ra are long holes that extend in the horizontal direction. Also, in the clincher holder 28, the guide hole 28Lb and the guide hole 28Rb are long holes that are inclined in a direction that an interval at the lower side is narrower than that at the upper side.

In the holder guide 29, the guide hole 29Lb and the guide hole 29Rb are long holes that are inclined in a direction that an interval at the lower side is narrower than that at the upper side. The clincher unit 2B rotates and moves the clincher 27L and the clincher 27R in the separating/contacting directions by trajectories of the shafts 27Ld, 27Rd of the clinchers 27L, 27R passing through the guide hole 29Lb and the guide hole 29Rb of the holder guide 29 and by an operation of pushing up the clinchers 27L, 27R by the clincher support part 29*a*.

The operations of the clincher unit of the modified embodiment are described. As shown in FIG. 40(*a*), when the leading ends of the legs 10*b* of the staple 10 penetrate the sheets P and protrude from the backside of the sheet P, one leg 10*b* contacts the clincher 27L and the other leg 10*b* contacts the clincher 27R. At a state where the leading ends of the legs 10*b* start to protrude from the backside of the sheet P, the descent of the clincher 28 is restrained.

When the staple 10 is further discharged and thus the leading ends of the legs 10*b* penetrate the sheets P, the clincher 28 can descend. Thereby, as shown in FIG. 40(*b*), the clincher holder 28 descends by the force of pressing the clincher holder 28 via the sheets P.

By the descent operation of the clincher holder 28, in the clincher 27L, the shaft 27Lc that is guided in the guide hole 28La of the clincher holder 28 is moved so that it comes close to the clincher 27R, and the shaft 27Ld that is guided in the guide hole 29Lb of the holder guide 29 is moved so that it comes close to the clincher 27R. Also, by the descent operation of the clincher holder 28, in the clincher 27R, the shaft 27Rc that is guided in the guide hole 28Ra of the clincher holder 28 is moved so that it comes close to the clincher 27L, and the shaft 27Rd that is guided in the guide hole 29Rb of the holder guide 29 is moved so that it comes close to the clincher 27L.

Thereby, the clinchers 27L, 27R are moved by the descent operation of the clincher holder 28 so that the interval between the shaft 27Lc and the shaft 27Rc is narrowed and the clincher 27L and the clincher 27R come close to each other.

Also, by the descent operation of the clincher holder 28, the pressing surface 27Lb of the clincher 27L is pressed by the clincher support part 29*a* and the pressing surface 27Rb of the clincher 27R is pressed by the clincher support part 29*a*.

Thereby, the clincher 27L is rotated upward about the shaft 27Lc serving as a fulcrum that is guided in the guide hole 28La of the clincher holder 28, and the clincher 27R is rotated upward about the shaft 27Rc serving as a fulcrum that is guided in the guide hole 28Ra of the clincher holder 28.

Accordingly, the one leg 10*b* of the staple 10 abutting on the clincher surface 27La of the clincher 27L and the other leg 10*b* of the staple 10 abutting on the clincher surface 27Ra of the clincher 27R are respectively applied with the inward bending force that is generated as the clincher 27L and the clincher 27R are moved in the approaching direction each other. The clincher 27L and the clincher 27R are rotated upward, so that they are bent inward.

When the clincher holder 28 descends to the lowest end position, the clincher 27L and the clincher 27R pushed up by the clincher support part 29*a* become substantially horizontal, as shown in FIG. 40(*c*). Thereby, the legs 10*b* having penetrated the sheets P are bent along the surface of the sheet P, so that the clinch operation is completed.

In the below, an operation of bending the legs 10*b* having penetrated the sheets P so that they are offset in the front-rear direction is described with reference to the respective drawings. The one leg 10*b* of the staple 10 abutting on the clincher surface 20La of the clincher 20L and the other leg lob of the staple 10 abutting on the clincher surface 20Ra of the clincher 20R are respectively bent inward by the operation of movement the clincher 20L and the clincher 20R so that they come close to each other and by the operation of rotating the clinchers upward.

The clincher unit 2A is arranged to be inclined to the staple crown 10*a* of the staple 10, and the clincher 20L and the clincher 20R are inclined relative to the staple crown 10*a* of the staple 10 and arranged to be offset in the front-rear direction, as shown in FIG. 16.

Thereby, by the horizontal movement and rotation operation of the clinchers 20L, 20R, the one leg 10*b* of the staple 10 is obliquely bent while being guided in an arrow NL direction of coming close to the clincher 20R by the inclination of the clincher surface 20La shown in FIG. 17. Also, the other leg 10*b* is obliquely bent while being guided in an arrow NR direction of coming close to the clincher 20L by the inclination of the clincher surface 20Ra.

The one leg 10*b* and the other leg 10*b* of the staple 10 are bent while being moved in the approaching direction each other, and then abut on the partition part 26*b* of the partition plate 26, respectively.

Thereby, when the number of sheets P to be bound is small, the two legs 10*b* are bent with an interval of the plate thickness of the partition plate 26 so that they do not overlap each other, as shown in FIG. 11(*c*).

In the configuration of guiding the legs in the recesses that are formed in the clinchers, it is necessary to secure a thickness of a convex part between the recess and the recess, so that it is not possible to narrow the interval between the legs. Also, when there is no partition between the clinchers, the legs may overlap each other.

In this exemplary embodiment, the clincher 20L and the clincher 20R are partitioned by the partition plate 26, so that it is possible to bend the two legs 10*b* with a narrow interval without the overlapping. Since the partition plate 26 also functions as a spring keeping the directions of the clinchers 20L, 20R, it may be possible to configure the staple 10 with a high strength thin steel plate.

Thereby, it is possible to set the interval between the two legs 10*b* by the lowest interval defined by the partition plate 26.

In the below, an operation of keeping the direction of the clincher unit 2A in the same direction at the standby state and at the pressing state is described with reference to the respective drawings. As described in FIGS. 19 and 20, in the clincher holder 21, the rear holder 21*b* positioned at the rear of the clinchers 20L, 20R is pushed up by the return spring 25 and the front holder 21*a* positioned at the front of the clinchers 20L, 20R is restrained from moving upward by the shafts 22La, 22Ra.

Thereby, the clincher holder 21 having the clinchers 20L, 20R attached thereto keeps the forward inclined posture shown with an arrow F1 at the standby state where it is pushed up by the return spring 25.

When the clincher holder 21 is pressed downward via the sheets P by the force with which the legs 10*b* of the staple 10 penetrate the sheets P, penetrating load F2 is applied to the clincher holder 21. When the clincher holder 21 is applied with the penetrating load F2 with the rear holder 21*b* being put on the engaging part 30 of the slider 3, the clincher holder keeps the forward inclined posture shown with the arrow F1.

The ascent and descent of the clincher holder 21 is guided by the clincher guide 24*a*. However, when a height of the clincher guide 24*a* is reduced so as to reduce a size in the height direction, an inclination is apt to occur in the front-rear direction.

When the directions of the clinchers are changed before and after the penetrating load is applied, the position of the sheets is deviated, so that the legs are deviated in the front-rear direction in the sheets during the penetration. As a result, the legs may not penetrate the sheets, so that the sheets may not be bound. In this exemplary embodiment, before and after the penetrating load is applied, the direction of the clincher holder 21 is not changed. Hence, it is possible to suppress the deviation of the sheets P and to thus enable the legs of the staple 10 to securely penetrate the sheets.

Meanwhile, in this exemplary embodiment, since the slider 3 is positioned at the rear of the clincher unit 2A, the pushing-up force is applied to the rear holder 21*b*. However, for a configuration where the slider 3 is disposed at the front of the clincher unit, when the pushing-up force is applied to the front holder, it is possible to keep the direction of the clincher holder same before and after the penetrating load is applied.

In the below, an operation of the lock mechanism 54 of the magazine 50 is described with reference to the respective drawings. As shown in FIGS. 28(*a*), at the state where the magazine 50 is accommodated in the magazine guide 51, the magazine lock spring 54*c* is compressed between the rear end of the staple guide 52 attached to the magazine 50 and the spring pressing part 54*e* of the magazine stopper 54*a*.

As the spring pressing part 54*e* is pressed, the magazine stopper 54*a* is rotated about the shaft 54*f* serving as a fulcrum in a direction along which the lock claw 54*d* is fitted in the lock opening 50*e* of the magazine 50, so that the lock claw 54*d* is fitted in the lock opening 50*e*. Thereby, the magazine 50 is kept with being accommodated in the magazine guide 51.

As shown in FIG. 28(*b*), when the switch part 54*g* is pressed, the pusher switch 54*b* rotates the magazine stopper 54*a*, which is connected via the shaft 54*h*, about the shaft 54*f* serving as a fulcrum, thereby separating the lock claw 54*d* of the magazine stopper 54*a* from the lock opening 50*e* of the magazine 50.

When the lock claw 54*d* of the magazine stopper 54*a* is separated from the lock opening 50*e* of the magazine 50, the magazine 50 is pressed forward by the restoring force of the compressed magazine lock spring 54*c*, so that the magazine 50 is withdrawn from the magazine guide 51.

When accommodating the magazine 50, the magazine 50 is pushed into the magazine guide 51, so that the staple guide 52 of the magazine 50 presses the spring pressing part 54*e* of the magazine stopper 54*a* via the magazine lock spring 54*c*. Thereby, the magazine stopper 54*a* is rotated about the shaft 54*f* serving as a fulcrum in a direction along which the lock claw 54*d* is fitted in the lock opening 50*e* of the magazine 50, so that the lock claw 54*d* is fitted in the lock opening 50*e*.

In the configuration of sliding the magazine, the force of the pusher spring pushing the staple is used to protrude the magazine. Therefore, when the number of the accommodated staples is large, the protruding amount of the magazine is increased, and when the number of the accommodated staples is small or when the staple is not accommodated, the protruding amount of the magazine is decreased.

However, in this exemplary embodiment, as the lock mechanism 54 is locked, the magazine lock spring 54*c* is applied with the constant pressing force, irrespective of the remaining number of the staples 10 in the magazine. Hence, it is possible to make the protruding amount of the magazine 50 constant.

In accordance with the above exemplary embodiment and the modifications thereof, a stapler may include a magazine unit 5 including a magazine 50 in which staples 10 are loaded; a driver unit 6 including a driver 60 configured to discharge the staples accommodated in the magazine 50; and a clincher unit 2A, 2B configured to bend legs 10*b* of the staple 10 discharged by the driver unit 6 and having penetrated sheets P. The clincher unit 2A, 2B may include a pair of clinchers 20L, 20R, 27L, 27R configured to respectively bend two legs 10*b* of the staple; and a clincher driving mechanism 21, 22L, 22R, 23, 28 configured to rotate and move the clinchers 20L, 20R, 27L, 27R in separating/contacting directions. The clincher driving mechanism 21, 22L, 22R, 23, 28 may move the pair of clinchers 20L, 20R, 27L, 27R in an approaching direction each other, as a movement of starting to bend the legs 10*b* of the staple having penetrated the sheets.

The clincher driving mechanism may include a pair of clincher links 22L, 22R that guides a rotation and a movement of the clinchers 20L, 20R in the separating/contacting directions; and a clincher support part 23 configured to push up the clinchers 20L, 20R by an ascent and descent operation of the clinchers.

The clincher driving mechanism may include a clincher holder 21, 28 having a guide hole 21L, 21R, 28La, 28Ra supporting the pair of clinchers 20L, 20R, 27L, 27R so that the clinchers can be rotated and moved in the separating/contacting directions. The clinchers 20L, 20R, 27L, 27R may move along the guide hole 21L, 21R, 28La, 28Ra by an ascent and descent operation of the clincher holder 21, 28.

According to the stapler of this structure, the legs of the staple are bent as the pair of clinchers is rotated and moved in a separating/contacting direction.

According to the stapler of this structure, regarding the movement of starting to bend the legs, the pair of clinchers is moved in the approaching direction, so that it is possible to apply the force of bending the legs inward.

Thereby, even at the state where the legs collide with the clincher surfaces at the upper sides of the rotating fulcrum points of the clinchers, it is possible to apply the force of bending the legs inward, thereby securely performing the clinch operation.

The clincher unit may include a return spring 25 that applies a force of pushing up the clincher holder 21. The pushing-up force by the return spring 25 may be applied to the clincher holder 21 in correspondence to a direction of the clincher holder which is defined by load that is applied when the staple penetrates the sheets.

The clincher holder 21 may include a bearing part 21*c*, to which the pushing-up force by the return spring 25 is applied, at a side abutting on a slider 3 that performs lock and lock-release of descent of the clincher holder 21.

The clincher holder 21 may have a height restraint part 21*d*, which restrains movement due to the pushing-up by the return spring 25, at an opposite side to the bearing part 21*c*.

The slider 3 may be disposed at one side of the clincher holder 21 and the one side of the clincher holder 21 abuts on the slider 3. The return spring 21 may be disposed at the other side of the clincher holder 21 and the bearing part 21*c* provided at the other side of the clincher holder 21 is applied with the force of the return spring 25.

According to the stapler of this structure, a direction of the clincher holder at the standby state corresponds to a direction of the clincher holder, which is determined by the load that is applied when the staple penetrates the sheets.

According to the stapler of this structure, the direction of the clincher holder is not changed before and after the penetrating load of the staple is applied. Hence, it is possible to suppress the deviation of the sheets and to thus enable the legs of the staple to securely penetrate the sheets.

Thereby, it is possible to bend the legs of the staple having penetrated the sheets, thereby securely binding the sheets.

The clincher holder 21, 28 may rotatably support the pair of clinchers 20L, 20R, 27L, 27R such that the clinchers are slightly offset in a front-rear direction. The pair of clinchers 20L, 20R, 27L, 27R may include, on surfaces facing the legs 10*b* of the staple discharged by the driver unit, clincher surfaces 20La, 20Ra, 27La, 27Ra that are respectively inclined in descent directions toward the clinchers adjacent to each other.

The clincher unit 2A may include a partition plate 26*b* that partitions the clinchers 20L, 20R. therebetween and has a partition part 26*b* protruding from the clincher surfaces 20La, 20Ra.

The clinchers 20L, 20R may be arranged to be inclined relative to a staple crown 10*a* of the staple discharged by the driver unit 6.

According to the stapler of this structure, by the rotation operation of the pair of clinchers, one leg of the staple is bent while it is guided in a direction of coming close to the other clincher by the inclination of the clincher surface of the one clincher. Also, the other leg is bent while it is guided in a direction of coming close to the one clincher by the inclination of the clincher surface of the other clincher. Also, the partition plate that partitions the pair of clinchers therebetween is provided, so that the two legs do not overlap each other.

According to the stapler of this structure, it is possible to bend the one leg and the other leg of the staple by the inclined clincher surfaces of the clinchers while moving the legs in an approaching direction each other. Hence, when the number of sheets to be bound is small, it is possible to bend the two legs without overlapping the two legs and widening the interval between the legs.

The partition plate 26 may include a spring part 26Lc, 26Rc that applies a force of keeping a direction to side surfaces of the pair of clinchers 20L, 20R.

The spring part 26Lc, 26Rc may be integrally formed with the partition plate 26 by protruding a part of the partition plate 26 in directions of the respective clinchers 20L, 20R.

According to the stapler of this structure, the directions of the clinchers are kept by the spring part, so that the rotation of the clinchers due to the own weights is prevented.

According to the stapler of this structure, it is possible to keep the directions of the clinchers by the spring part. Hence, after actually discharging the staple, it is possible to keep the directions of the clinchers, which are substantially horizontal at the descent position of the clincher holder, until the clinchers are pressed by the legs of the staple.

Thereby, at the standby state, the opening of the part at which the clinchers are exposed is blocked by the clinchers. Thus, it is possible to remove the cause of the introduction of the foreign matters. Also, it is possible to improve the outward appearance.

The clincher driving mechanism may include: a clincher holder 28 having a first guide hole 28La, 28Ra supporting the pair of clinchers 27L, 27R so that the clinchers 27L, 27R can be rotated and moved in the separating/contacting directions; a holder guide 29 having a second guide hole 29La, 29Ra that rotates and moves the clinchers 27L, 27R in the separating/contacting directions by an ascent and descent operation of the clincher holder 28; and a clincher support part 29*a* that pushes up the clinchers 27L, 27R by an ascent and descent operation of the clincher holder 28.

The invention is applied to the staple capable of increasing the number of sheets to be bound by using the staple having long legs.

DESCRIPTION OF REFERENCE NUMERALS

1A: stapler
10: staple
10*a*: staple crown
10*b*: leg
11*a*: lower handle unit
11*b*: upper handle unit
2A, 2B: clincher unit
20L, 20R: clincher
21: clincher holder
22L, 22R: clincher link
23: clincher support part
24: clincher frame
25: return spring
26: partition plate
3: slider
30: engaging part
31: link bearing part
4: lower handle frame
40: upper handle attachment part
41: lower handle cover
42: clincher cover
5: magazine unit
50: magazine
51: magazine guide
52: staple guide
53: staple holder
54: lock mechanism
55: pusher
55*a*: pusher spring
56: spring guide
57: guide cover
58: link
6: driver unit
60: driver
61: driver arm
7: handle unit
70: handle arm
71: upper handle cover
72: front cover

What is claimed is:

1. A stapler comprising:

a magazine unit including a magazine in which staples are loaded;

a driver unit including a driver configured to discharge the staples accommodated in the magazine; and a clincher unit configured to bend legs of the staple discharged by the driver unit and having penetrated sheets, wherein the clincher unit includes:

a pair of clinchers configured to respectively bend two legs of the staple;

a clincher driving mechanism configured to rotate and move the clinchers in separating/contacting directions, and a pair of shafts configured to respectively support the pair of clinchers rotatably, and wherein the clincher driving mechanism is configured to move the pair of clinchers toward each other by moving the pair of shafts toward each other, as the clinchers start to bend the legs of the staple having penetrated the sheets.

2. The stapler according to claim 1, wherein the clincher driving mechanism includes:

a pair of clincher links that guides a rotation and a movement of the clinchers in the separating/contacting directions; and a clincher support part configured to push up the clinchers by an ascent and descent operation of the clinchers.

3. The stapler according to claim 2, wherein the clincher driving mechanism includes a clincher holder having a guide hole supporting the pair of clinchers so that the clinchers can be rotated and moved in the separating/contacting directions, and wherein the clinchers move along the guide hole by an ascent and descent operation of the clincher holder.

4. The stapler according to claim 3, wherein the clincher unit further includes a return spring that applies a force of pushing up the clincher holder, and wherein the pushing-up force by the return spring is applied to the clincher holder in correspondence to a direction of the clincher holder which is defined by load that is applied when the staple penetrates the sheets.

5. The stapler according to claim 4, wherein the clincher holder includes a bearing part, to which the pushing-up force by the return spring is applied, at a side abutting on a slider that performs lock and lock-release of descent of the clincher holder.

6. The stapler according to claim 5, wherein the clincher holder has a height restraint part, which restrains movement due to the pushing-up by the return spring, at an opposite side to the bearing part.

7. The stapler according to claim 6, wherein the slider is disposed at one side of the clincher holder and the one side of the clincher holder abuts on the slider, and wherein the return spring is disposed at the other side of the clincher holder and the bearing part provided at the other side of the clincher holder is applied with the force of the return spring.

8. The stapler according to claim 3, wherein the clincher holder rotatably supports the pair of clinchers such that the clinchers are slightly offset in a front-rear direction, and wherein the pair of clinchers include, on surfaces facing the legs of the staple discharged by the driver unit, clincher surfaces that are respectively inclined in descent directions toward the clinchers adjacent to each other.

9. The stapler according to claim 8, wherein the clincher unit includes a partition plate that partitions the clinchers therebetween and has a partition part protruding from the clincher surfaces.

10. The stapler according to claim 9, wherein the clinchers are arranged to be inclined relative to a staple crown of the staple discharged by the driver unit.

11. The stapler according to claim 10, wherein the partition plate includes a spring part that applies a force of keeping a direction to side surfaces of the pair of clinchers.

12. The stapler according to claim 11, wherein the spring part is integrally formed with the partition plate by protruding a part of the partition plate in directions of the respective clinchers.

13. The stapler according to claim 1, wherein the clincher driving mechanism includes:

a clincher holder having a first guide hole supporting the pair of clinchers so that the clinchers can be rotated and moved in the separating/contacting directions;

a holder guide having a second guide hole that rotates and moves the clinchers in the separating/contacting directions by an ascent and descent operation of the clincher holder; and a clincher support part that pushes up the clinchers by an ascent and descent operation of the clincher holder.

* * * * *